US006416375B1

(12) United States Patent
Cho et al.

(10) Patent No.: US 6,416,375 B1
(45) **Date of Patent: *Jul. 9, 2002**

(54) SEALING OF PLATE STRUCTURES

(75) Inventors: Steven T. Cho, Santa Clara; Alfred S. Conte, Hollister; Paul N. Ludwig, Livermore; Anthony P. Schmid, Solana Beach; Theodore S. Fahlen, San Jose; Robert J. Pressley, Cupertino, all of CA (US)

(73) Assignees: Candescent Technologies Corporation; Candescent Intellectual Property Services, Inc., both of San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/632,372

(22) Filed: Aug. 3, 2000

Related U.S. Application Data

(62) Division of application No. 08/766,477, filed on Dec. 12, 1996, now Pat. No. 6,109,994.

(51) Int. Cl.[7] ..... H01J 9/26
(52) U.S. Cl. ..... 445/25
(58) Field of Search ..... 445/25

(56) References Cited

U.S. PATENT DOCUMENTS

| | | | | |
|---|---|---|---|---|
| 3,874,549 A | | 4/1975 | Hascoe | |
| 4,021,219 A | | 5/1977 | Stockdale et al. | |
| 4,618,801 A | | 10/1986 | Kakino | |
| 4,683,154 A | | 7/1987 | Benson et al. | |
| 5,424,605 A | | 6/1995 | Lovoi | |
| 5,477,105 A | | 12/1995 | Curtin et al. | |
| 5,489,321 A | | 2/1996 | Tracy et al. | |
| 5,548,181 A | | 8/1996 | Jones | |
| 5,589,731 A | | 12/1996 | Fahlen et al. | |
| 5,693,111 A | | 12/1997 | Kadowaki et al. | |
| 5,697,825 A | * | 12/1997 | Dynka et al. | 445/25 |
| 5,807,154 A | * | 9/1998 | Watkins | 445/25 |
| 5,820,435 A | * | 10/1998 | Cooper et al. | 445/25 |
| 5,827,102 A | | 10/1998 | Watkins et al. | |
| 6,109,994 A | * | 8/2000 | Cho et al. | 445/25 |

OTHER PUBLICATIONS

Branst et al, "The Challenge of Flat Panel Display Sealing," *Semiconductor Int'l*, Jan. 1996, pp. 109–112.

Jellison et al, "Laser Materials Processing at Sandia National Labatories," Applications of Lasers and Electrooptics, Conference, Oct. 17–20, 1994, sponsored by Dept. of Energy, 10 pps.

Tannas, *Flat–Panel Displays and CRTs* (Van Nostrand Reinhold), Section 7.9, 1985, pp. 217–221.

Zimmerman et al, "Glass Panel Alignment and Sealing for Flat–Panel Displays," Viewgraph Presentation, NCAICM Workshop, Contract No. F33615–94–C–1415, Nov. 30–Dec. 2, 1994, 29 viewgraphs.

Zimmerman et al, "Glass Panel Alignment and Sealing for Flat–Panel Displays," Contract Summary, ARPA High Def. Systs. Info. Exch. Conf., Apr. 30–May 3, 1995, 2 pp.

* cited by examiner

*Primary Examiner*—Kenneth J. Ramsey
(74) *Attorney, Agent, or Firm*—Skjerven Morrill LLP; Ronald J. Meetin

(57) ABSTRACT

A pair of plate structures (40 and 44), such as a baseplate structure and a faceplate structure of a flat-panel display, are sealed to each other by first attaching the plate structures to each other, typically at multiple attachment locations, in a non-vacuum environment. The plate structures are then hermetically sealed to each other, typically through an outer wall (44) or/and typically by gap jumping, in a vacuum environment.

36 Claims, 11 Drawing Sheets

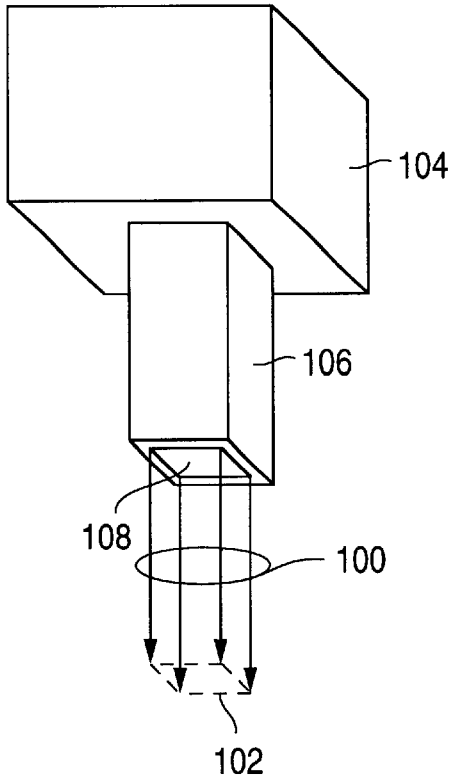
Fig. 11a
Fig. 11b
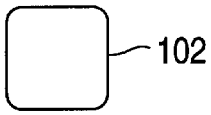
Fig. 11c
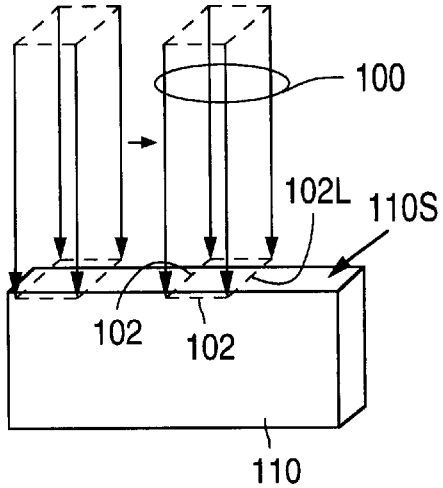

SEALING OF PLATE STRUCTURES

CROSS-REFERENCE TO RELATED APPLICATION.

This is a division of U.S. patent application Ser. No. 08/766,477, filed Dec. 12, 1996, now U.S. Pat. No. 6,109,994. This is also related to Cooper et al, U.S. patent application Ser. No. 08/766,474, filed Dec. 12, 1996, now U.S. Pat. No. 5,820,435. To the extent not repeated herein, the contents of Cooper et al are incorporated by reference.

FIELD OF USE

This invention relates to techniques for sealing structures, particularly flat-panel devices.

BACKGROUND ART

A flat-panel device contains a pair of generally flat plates connected together through an intermediate mechanism. The two plates are typically rectangular in shape. The thickness of the relatively flat-structure formed with the two plates and the intermediate connecting mechanism is small compared to the diagonal length of either plate.

When used for displaying information, a flat-panel device is typically referred to as a flat-panel display. The two plates in a flat-panel display are commonly termed the faceplate (or frontplate) and the baseplate (or backplate). The faceplate, which provides the viewing surface for the information, is part of a faceplate structure containing one or more layers formed over the faceplate. The baseplate is similarly part of a baseplate structure containing one or more layers formed over the baseplate. The faceplate structure and the baseplate structure are sealed together, typically through an outer wall, to form a sealed enclosure.

A flat-panel display utilizes mechanisms such as cathode rays (electrons), plasmas, and liquid crystals to display information on the faceplate. Flat-panel displays that employ these three mechanisms are generally referred to as cathode-ray tube ("CRT") displays, plasma displays, and liquid-crystal displays. The constituency and arrangement of the display's faceplate structure and baseplate structure depend on the type of mechanism utilized to display information on the faceplate.

In a flat-panel CRT display, electron-emissive elements are typically provided over the interior surface of the baseplate. The electron-emissive elements are arranged in a matrix of rows and columns of picture elements (pixels). Each pixel typically contains a large number of individual electron-emissive elements. When the electron-emissive elements are appropriately excited, they emit electrons that strike phosphors arranged in corresponding pixels situated over the interior surface of the faceplate.

The faceplate in a flat-panel CRT display consists of a transparent material such as glass. Upon being struck by electrons emitted from the electron-emissive elements, the phosphors situated over the interior surface of the faceplate emit light visible on the exterior surface of the faceplate. By appropriately controlling the electron flow from the baseplate structure to the faceplate structure, a suitable image is displayed on the faceplate.

The electron-emissive elements in a flat-panel CRT display typically emit electrons according to a field-emission (cold emission) technique or a thermionic emission technique. In either case, but especially for the field-emission technique, electron emission needs to occur in a highly evacuated environment for the CRT display to operate properly and to avoid rapid degradation in performance. The enclosure formed by the faceplate structure, the baseplate structure, and the outer wall is thus fabricated in such a manner as to be at a high vacuum, typically a pressure of $10^{-7}$ torr or less for a flat-panel CRT display of the field-emission type. One or more spacers are commonly situated between the faceplate structure and the baseplate structure to prevent outside forces, such as air pressure, from collapsing the display.

Any degradation of the vacuum can lead to various problems such as non-uniform brightness of the display caused by contaminant gases that degrade the electron-emissive elements. The contaminant gases can, for example, come from the phosphors. Degradation of the electron-emissive elements also reduces the working life of the display. It is thus critical to hermetically seal a flat-panel CRT display.

A flat-panel CRT display of the field-emission type, often referred to as a field-emission display ("FED"), is conventionally sealed in air and then evacuated through pump-out tubulation provided on the display. FIGS. 1*a*–1*d* (collectively "FIG. 1") illustrate one such conventional procedure for sealing an FED consisting of a baseplate structure 10, a faceplate structure 12, an outer wall 14, and multiple spacer walls 16.

At the point shown in FIG. 1*a*, spacer walls 16 are mounted on the interior surface of faceplate structure 12, and outer wall 14 is connected to the interior surface of faceplate structure 12 through frit (sealing glass) 18 provided along the faceplate edge of outer wall 14. Frit 20 is situated along the baseplate edge of outer wall 14. A tube 22 is sealed to the exterior surface of baseplate structure 10 through frit 24 at an opening 26 in baseplate structure 10. A getter 28 for collecting contaminant gases is typically provided along the inside of tube 22. The structure formed with baseplate structure 12, outer wall 14, and spacer 16 is physically separate from the structure formed with baseplate structure 10, tube 22, and getter 28 prior to sealing the display.

Structures 12/14/16 and 10/22/28 are placed in an alignment fixture 30, aligned to each other, and brought into physical contact along frit 20 as shown in FIG. 1*b*. Alignment fixture 30 is located in, or is placed in, an oven 32. After being aligned and brought into contact, structures 12/14/16 and 10/22/28 are slowly heated to a sealing temperature ranging from 450° C. to greater than 600° C. Frit 20 melts, sealing structure 12/14/16 to structure 10/22/28. The sealed FED is slowly cooled down to room temperature. The heating/sealing/cool-down process typically takes 1 hr.

After having been sealed, the FED is removed from alignment fixture 30 and oven 32, and is placed in another oven 34. See FIG. 1*c*. A vacuum pumping system 36 is connected to tube 22. With a heating element 38 placed around tube 22, the FED is pumped down to a high vacuum level through tube 22. The FED is then brought slowly up to a high temperature and baked for several hours to remove contaminant gases from the material of the FED. When a suitable low pressure can be maintained in the FED at the elevated temperature, the FED is cooled to room temperature, and tube 22 is heated through heating element 38 until tube 22 closes to seal the FED at a high vacuum. The FED is then removed from oven 34 and disconnected from vacuum pump 36. FIG. 1*d* shows the sealed FED.

The sealing process of FIG. 1 is unsatisfactory for a number of reasons. Even though multiple FEDs can be sealed at the same time, the sealing procedure often takes too long to meet commercial needs. In addition, the entire FED is heated to a high temperature for a long period. This creates concerns relating to alignment tolerances and can degrade certain of the materials in the FED, sometimes leading to cracking. Furthermore, tube 22 protrudes out of the FED. Consequently, the FED must be handled very carefully to avoid breaking tube 22 and destroying the FED. It would be extremely beneficial to have a technique for sealing a flat-panel device, especially a flat-panel display of the field-emission CRT type, that overcomes the foregoing problems and eliminates the need for pump-out tubulation such as tube 22.

GENERAL DISCLOSURE OF THE INVENTION

The present invention furnishes a technique for sealing portions of a structure together in such a manner that the sealed structure can readily achieve a reduced pressure state, typically a high vacuum level, without the necessity for providing the structure with an awkward pressure-reduction device, such as pump-out tubulation, that protrudes substantially beyond the remainder of the sealed structure. In the invention, sealing is effected by a gap-jumping technique in which energy is applied locally along a specified area to create the seal. The term "local" or "locally" as used here in describing an energy transfer means that the energy is directed selectively to certain material largely intended to receive the energy without being significantly transferred to nearby material not intended to receive the energy.

In using the gap-jumping technique of the invention to seal a structure, the entire structure is typically heated prior to completing the seal in order to drive out contaminant gases and alleviate stress that might otherwise arise during completion of the seal. However, the maximum temperature reached during the outgassing/stress-relieving operation, typically in the vicinity of 300° C., is much less than that normally reached in prior art sealing processes such as that described above in which sealing is performed by global heating. Problems such as cracking and degradation of the components of the structure are greatly reduced with the present gap-jumping sealing technique.

The sealing technique of the invention can be performed in much less time than a prior art sealing process of the type described above. The present sealing technique is particularly suitable for sealing a flat-panel device, especially a flat-panel display of the CRT type. With the necessity for awkwardly protruding pump-out tubulatlion eliminated, the possibility of destroying the sealed structure by breaking a pump-out tube is avoided. In short, the invention provides a large advantage over prior art hermetic sealing techniques.

Broadly, the sealing technique of the invention involves positioning a sealing area of one body near a matching sealing area of another body such that a gap at least partially separates the two sealing areas. The gap typically has an average height of at least 25 $\mu$m.

In one implementation of the present sealing technique, a pair of local energy transfers are now performed. Specifically, energy is initially transferred locally to material of a specified one of the bodies along part of the gap while the bodies are in a non-vacuum environment. The initial local energy transfer causes material of the bodies to bridge that part of the gap and partially seal the two bodies together along the sealing areas. Energy is subsequently transferred locally to material of the specified body along the remainder of the gap while the bodies are in a vacuum environment, normally a high vacuum. The subsequent local energy transfer causes material of the bodies to bridge the remainder of the gap and complete the sealing of the two bodies together.

The local energy that causes the gap to be bridged (or jumped) is typically light energy, preferably furnished by a laser in at least one of the energy-transferring steps. Alternatively, a focused lamp can furnish the light energy. Also, at least one of the energy-transferring steps can be performed with another type of local energy such as locally directed radio-frequency ("RF") wave energy, including microwave energy. In a typical case, the material of the specified body—i.e., the body that receives the local energy in both the initial non-vacuum energy-transferring step and the subsequent vacuum energy-transferring step—bridges largely all of the gap.

Depending on the geometry of the structure to be sealed, on the materials used in the structure, and on the conditions of the local energy transfers, one or more of several mechanisms appear to be responsible for gap jumping in the present invention. One mechanism is surface tension. As energy is locally transferred to the specified body along its sealing area at the gap between the two bodies, the material along the sealing area of the specified body melts and, especially if the sealing area is relatively flat up to a pair of corners, attempts to occupy a volume having a reduced surface area. This causes material of the specified body along its sealing area to curve towards the sealing area of the other body.

Gases trapped in the material of the specified body near its sealing area, or created by changes in the composition of the material of the specified body along its sealing area, may help cause material of the sealing area of the specified body to move towards the other sealing area. Also, in some cases, the material of the specified body along its sealing area may undergo a phase change that results in a decrease in density so that the volume of the material increases, causing it to expand towards the other sealing area.

In any event, the molten material of the specified body along its sealing area comes into contact with the material of the other body along its sealing area, wets that material, and flows to form a seal. The net result is that application of local energy to the sealing area of the specified body causes part of its material to close the gap between the two sealing areas. The gap must, of course, be sufficiently small so as to be capable of being bridged due to the local energy transfer. We have successfully jumped gaps of up to 300 $\mu$m utilizing local light energy transfer in accordance with the invention.

Use of a non-vacuum environment followed by a high vacuum environment to perform the energy-transferring steps yields a number of benefits. Performing the initial local energy transfer in a non-vacuum environment to bridge part of the gap normally enables the material that bridges that part of the gap to have a lower porosity, and thus a higher density, than otherwise identical material subjected to the same type of local energy transfer but in a high vacuum. When the non-vacuum environment consists largely of nitrogen (a relatively non-reactive gas) or/and an inert gas during at least part of the initial local energy transfer, the number of undesired chemical reactions that occur between gases in the non-vacuum environment and the materials being sealed is greatly reduced. The net result is that a strong seal is formed with the material that bridges part of the gap during the initial energy-transferring step.

With the sealed structure forming an enclosure at the end of the subsequent energy-transferring step, performing the subsequent local energy transfer in a high vacuum environment to bridge the remainder of the gap and finish the seal results in a high vacuum being created in the enclosure. Importantly, the vacuum is produced in the enclosure during the end of the sealing procedure without using a device such as a pump-out tube to create the vacuum. The combination of a non-vacuum environment for the initial local energy transfer and a high vacuum environment for the subsequent local energy transfer thereby enables a strong hermetic seal to be made between the two bodies while avoiding the necessity of using pump-out tubulation to produce a high vacuum in the sealed enclosure.

When used in sealing a structure such as a flat-panel display, the sealing technique of the invention entails positioning a first edge of a primary wall (e.g., an outer wall) near a matching sealing area of a first plate structure (e.g., a baseplate structure) such that a gap at least partially separates the first edge of the wall from the sealing area of the first plate structure. Energy is then transferred locally to material of the wall along the gap to produce gap jumping that closes the gap. The local energy transfer is typically performed by the composite non-vacuum/vacuum approach described above.

A second edge of the wall opposite the first edge is usually sealed (or joined) to a second plate structure (e.g., a faceplate structure) along another matching sealing area. Sealing of the second plate structure to the wall is typically done in a non-vacuum environment before sealing the first plate structure to the wall. However, sealing of the second plate structure to the wall can be performed at the same time that the first plate structure is sealed to the wall utilizing, for example, a double-laser technique. In either case, the gap-jumping seal of the first plate structure to the wall is typically completed in a vacuum environment, again normally a high vacuum. The resulting structure forms a sealed enclosure at a high vacuum level.

Various techniques can be utilized to enhance the sealing process of the invention. For example, venting slots can be provided along the first edge of the wall to assist in removing gases from the enclosure as the first plate structure is sealed to the wall. A positioning structure, such as a plurality of posts, can be employed to hold the plate structures in a fixed position relative to each other before using gap jumping to seal the first plate structure to the wall. The positioning structure is preferably located outside the wall and thus has no effect on the sealed enclosure.

The wall can have a profile in two distinct portions—e.g., generally shaped like a "T" or an inverted "L"—in which one of the portions is wider than the other. A surface of the wider portion forms the wall's first edge. During local transfer of energy to the wall along its first edge, the wider portion compresses along its width to facilitate gap jumping.

When a light source that produces a beam at wavelengths that fall into multiple different wavelength domains is employed to perform the subsequent energy-transferring step in which sealing of the first plate structure to the wall is completed, the same light source can be utilized concurrently to transfer energy locally to material of the first plate structure along its sealing area in order to raise that material to a temperature close to the melting temperature of the wall along its first edge. In this case, the beam energy in one of these wavelength domains is transferred locally to material of the wall along its first edge while the beam energy in another of the wavelength domains is simultaneously transferred locally to material of the first plate structure along its sealing area. Locally heating both the first plate structure and the wall in this way provides stronger bonding at the seal interface and thus increases the hermeticity of the seal.

The laser employed in performing local energy transfer in the sealing processes of the invention preferably generates a laser beam of selected non-circular, typically rectangular, cross section. Due to the mechanics of how energy is transferred to a sealing area, the rectangular cross,section of the laser beam causes the light energy to be distributed more uniformly across the sealing area. The creation of bubbles is substantially inhibited in the sealed material, thereby also producing a stronger seal. In short, the invention provides a highly consistent, effective technique for hermetically sealing a flat-panel device, especially a flat-panel display of the CRT type.

BRIEF DESCRIPTION OF THE DRAWINGS

FIGS. 2*b and 2*c are cross-sectional views representing additional steps employable according to the invention in the gap-jumping sealing process of FIGS. 2*a*–2*e*.

FIGS. 2*c*' and 2*d*' are cross-sectional views representing steps substitutable according to the invention for the steps of FIGS. 2*c* and 2*d* in the gap-jumping sealing process of FIGS. 2*a*–2*e*.

FIG. 11*a* is a schematic perspective view of a laser that produces a laser beam of generally rectangular cross section in accordance with the invention for providing light energy in the gap jumping sealing processes of the invention.

FIG. 11*b* is a view of the cross section of the laser beam in FIG. 11*a*.

FIG. 11*c* is a perspective view illustrating how the laser beam of FIGS. 11*a* and 11*b* traverses a sealing area in accordance with the invention.

Like reference symbols are employed in the drawings and in the description of the preferred embodiments to represent the same, or very similar, item or items.

DESCRIPTION OF THE PREFERRED EMBODIMENTS

Figure 1A:
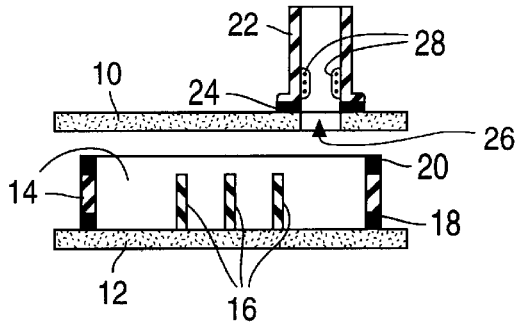
Fig. 1a PRIOR ART
FIGS. 1*a*–1*d* are cross-sectional views representing steps in a conventional process for sealing a flat-panel CRT display.
Figure 1B:
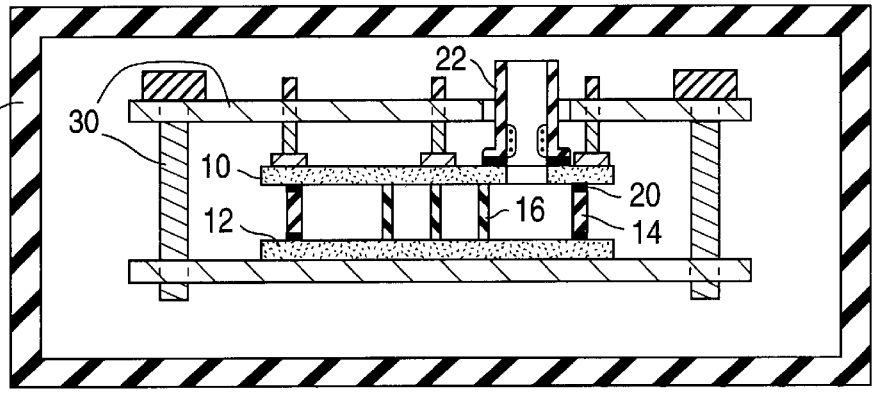
Fig. 1b PRIOR ART
Figure 1C:
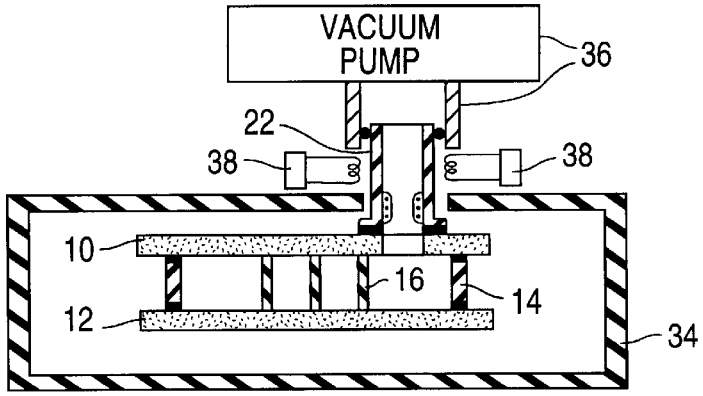
Fig. 1c PRIOR ART
Figure 1D:
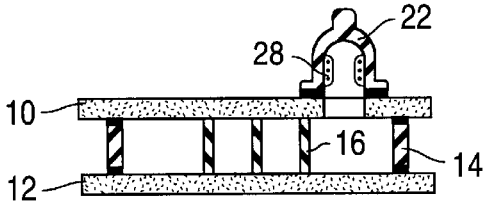
Fig. 1d PRIOR ART
Figure 2A:
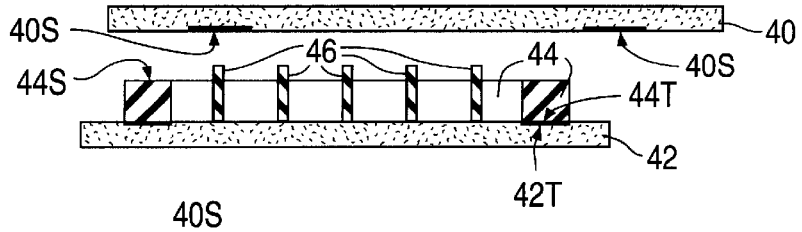
FIGS. 2*a*–2*e* are cross-sectional views representing steps in a process for sealing a flat-panel display using local energy transfer to produce gap jumping in accordance with the invention.
Figure 2B:
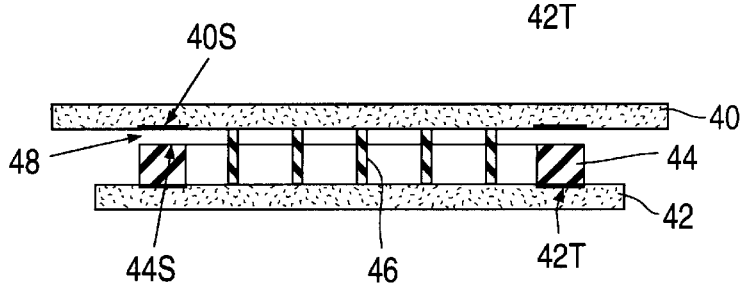
Figure 2C:
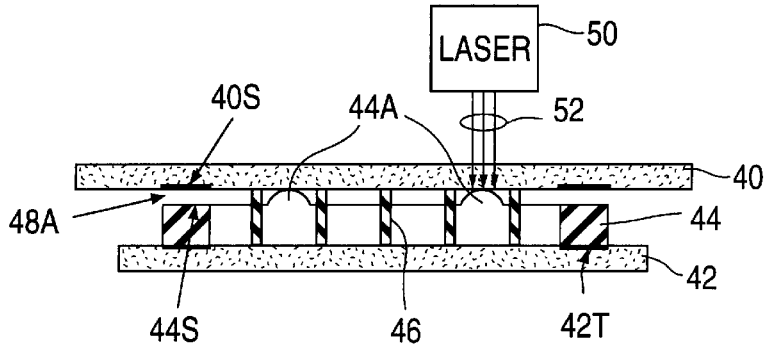

FIGS. 2*a*–2*e* (collectively "FIG. 2") illustrate a general technique for hermetically sealing a flat-panel display according to the teachings of the invention. The technique illustrated in FIG. 2 utilizes local energy transfer to produce gap jumping that causes separate portions of the flat-panel display to be sealed to one another. FIGS. 2*b and 2*c, which are dealt with after describing the process of FIG. 2, illustrate additional steps that can be employed in the process of FIG. 2. FIGS. 2*c*' and 2*d*', likewise dealt with after describing the process of FIG. 2, present an alternative to the steps of FIGS. 2*c* and 2*d*. FIG. 3 presents a perspective view of the unsealed flat-panel display at the initial step of FIG. 2*a* in the sealing process.

As used here, the "exterior" surface of a faceplate structure in a flat-panel display is the surface on which the display's image is visible to a viewer. The opposite side of the faceplate structure is referred to as its "interior" surface even though part of the interior surface of the faceplate structure is normally outside the enclosure formed by sealing the faceplate structure to a baseplate structure through an outer wall. Likewise, the surface of the baseplate structure situated opposite the interior surface of the faceplate structure is referred to as the "interior" surface of the baseplate structure even though part of the interior surface of the baseplate structure is normally outside the sealed enclosure formed with the faceplate structure, the baseplate structure, and the outer wall. The side of the baseplate structure opposite to its interior surface is referred to as the "exterior" surface of the baseplate structure.

With the foregoing in mind, the components of the flat-panel display sealed according to the process of FIG. 2 are a baseplate structure (or body) 40, a faceplate structure (or body) 42, an outer wall 44, and a group of spacer walls 46. Baseplate structure 40 and faceplate structure 42 are generally rectangular in shape. The internal constituency of plate structures 40 and 42 is not shown. However, baseplate structure 40 consists of a baseplate and one or more layers formed over the interior surface of the baseplate. Faceplate structure 42 consists of a transparent faceplate and one or more layers formed over the interior surface of the faceplate. Outer wall 44 consists of four sub-walls arranged in a rectangle. Spacer walls 46 maintain a constant spacing between plate structures 40 and 42 in the sealed display, and enable the display to withstand external forces such as air pressure.

As described below, baseplate structure 40 is hermetically sealed to faceplate structure 42 through outer wall 44. The sealing operation normally involves raising the components of the flat-panel display to elevated temperature. To reduce the likelihood of cracking the flat-panel display, especially during cool-down to room temperature, outer wall 44 is typically chosen to consist of material having a coefficient of thermal expansion ("CTE") that approximately matches the CTEs of the baseplate and the faceplate.

A flat-panel display sealed according to the process of FIG. 2 can be anyone of a number of different types of flat-panel displays such as CRT displays, plasma displays, vacuum fluorescent displays, and liquid-crystal displays. In the flat-panel CRT display example, baseplate structure 40 contains a two-dimensional array of pixels of electron-emissive elements provided over the baseplate. The electron-emissive elements form a field-emission cathode.

Specifically, baseplate structure 40 in a flat-panel CRT display of the field-emission type typically has a group of emitter row electrodes that extend across the baseplate in a row direction. An inter-electrode dielectric layer overlays the emitter electrodes and contacts the baseplate in the space between the emitter electrodes. At each pixel location in baseplate structure 40, a large number of openings extend through the inter-electrode dielectric layer down to a corresponding one of the emitter electrodes. Electron-emissive elements, typically in the shape of cones or filaments, are situated in each opening in the inter-electrode dielectric.

A patterned gate layer is situated on the inter-electrode dielectric. Each electron-emissive element is exposed through a corresponding opening in the gate layer. A group of column electrodes, either created from the patterned gate layer or created from a separate column-electrode layer that contacts the gate layer, extend over the inter-electrode dielectric in a column direction perpendicular to the row direction. The emission of electrons from the pixel at the intersection of each row electrode and each column electrode is controlled by applying appropriate voltages to the row and column electrodes.

Faceplate structure 42 in the flat-panel field-emission display (again, "FED") contains a two-dimensional array of phosphor pixels formed over the interior surface of the transparent faceplate. An anode, or collector electrode, is situated adjacent to the phosphors in structure 42. The anode may be situated over the phosphors, and thus is separated from the faceplate by the phosphors. In this case, the anode typically consists of a thin layer of electrically conductive light-reflective material, such as aluminum, through which the emitted electrons can readily pass to strike the phosphors. The light-reflective layer increases the display brightness by redirecting some of the rear-directed light back towards the faceplate. U.S. Pat. Nos. 5,424,605 and 5,477,105 describe examples of FEDs having faceplate structure 42 arranged in the preceding manner. Alternatively, the anode can be formed with a thin layer of electrically conductive transparent material, such as indium tin oxide, situated between the faceplate and the phosphors.

When the FED is arranged in either of the preceding ways, application of appropriate voltages to the row and column electrodes in baseplate structure 40 causes electrons to be extracted from the electron-emissive elements at selected pixels. The anode, to which a suitably high voltage is applied, draws the extracted electrons towards phosphors in corresponding pixels of faceplate structure 42. As the electrons strike the phosphors, they emit light visible on the exterior surface of the faceplate to form a desired image. For color operation, each phosphor pixel contains three phosphor sub-pixels that respectively emit blue, red, and green light upon being struck by electrons emitted from electron-emissive elements in corresponding sub-pixels formed over the baseplate.

The thickness of outer wall 44 is in the range of 1–4 mm. Although the dimensions have been adjusted in FIGS. 2 and 3 to facilitate illustration of the components of the flat-panel display, the height of outer wall 44 is usually of the same order of magnitude as the outer wall thickness. For example, the outer wall height is typically 1–1.5 mm.

The four sub-walls of outer wall 44 can be formed individually and later joined to one another directly or through four corner pieces. The four sub-walls can also be a single piece of appropriately shaped material. Outer wall 44 normally consists of frit, such as Ferro 2004 frit combined with filler and a stain, arranged in a rectangular annulus as indicated in FIG. 3. The frit in outer wall 44 melts at temperature in the range of 400–500° C. The frit melting temperature is much less, typically 100° C. less, than the melting, temperature of any of the materials of plate structures 40 and 42 and spacer walls 46.

At the initial stage shown in FIGS. 2*a* and 3, outer wall 44 has been sealed (or joined) to faceplate structure 42 along (a) an annular rectangular sealing area formed by the lower edge 44T of outer wall 44 and (b) a matching annular rectangular sealing area 42T along the interior surface of faceplate structure 42. Faceplate sealing area 42T is indicated by dark line in FIG. 2. However, this is only for illustrative purposes. Faceplate structure 42 typically does not have a feature that expressly identifies the location of sealing area 42T.

In sealing outer wall 44 to faceplate structure 42, components 42 and 44 are first placed in a suitable position relative to one another with lower wall edge 44T aligned to faceplate sealing area 42T. The alignment is performed with a suitable alignment fixture. Lower wall edge 44T normally comes into contact with faceplate sealing area 42T during the positioning step.

The sealing of outer wall 44 to faceplate structure 42 can be done in a number of ways after the alignment is complete. Normally, the sealing of wall 44 to structure 42 is performed under non-vacuum conditions at a pressure close to room pressure, typically in an environment of dry nitrogen or an inert gas such as argon.

The faceplate-structure-to-outer-wall seal can be effected in a sealing oven by raising faceplate structure 42 and outer wall 44 to a suitable sealing temperature to produce the seal and then cooling the structure down to room temperature. The temperature ramp-up and ramp-down during the global heating operation in the sealing oven each typically take 3 hr. The faceplate-structure-to-outer-wall sealing temperature, typically in the vicinity of 400–550° C., equals or slightly exceeds the melting temperature of the frit in outer wall 44, and therefore causes the frit to be in a molten state for a brief period of time. The faceplate-structure-to-outer-wall sealing temperature is sufficiently low to avoid melting, or otherwise damaging, any part of faceplate structure 42.

Alternatively, outer wall 44 can be sealed to faceplate structure 42 with a laser after raising wall 44 and structure 42 to a bias temperature of 200–350° C., typically 300° C. The elevated temperature during the laser seal is employed to alleviate stress along the sealing interface and reduce the likelihood of cracking.

Spacer walls 46 are mounted on the interior surface of faceplate structure 42 within outer wall 44. Spacer walls 46 are normally taller than outer wall 44. In particular, spacer walls 46 extend further away, typically an average of at least 50 $\mu$m further away, from faceplate structure 42 than outer wall 44. Although normally mounted on faceplate structure 42 after sealing outer wall 44 to structure 42, spacer walls 46 can be mounted on structure 42 before the faceplate-structure-to-outer-wall seal. In that case, the faceplate-structure-to-outer-wall sealing temperature is sufficiently low to avoid melting, or otherwise damaging, spacer walls 46.

Composite structure 42/44/46 is to be hermetically sealed to structure 40 along (a) an annular rectangular sealing area formed by the upper edge 44S of outer wall 44 and (b) an annular rectangular sealing area 40S along the interior surface of baseplate structure 40. To indicate where baseplate sealing area 40S is situated on baseplate structure 40, sealing area 40S is indicated by dark line in FIG. 2 and by dotted line in FIG. 3. As with faceplate sealing area 42T, this is only for illustrative purposes. A feature that expressly identifies the location of baseplate sealing area 40S is typically not provided on baseplate structure 40. As indicated in FIG. 3, the shape of sealing area 40S matches the shape of wall-edge sealing area 44S.

Baseplate structure 40 is transparent along at least part of, normally the large majority of, sealing area 40S. Opaque electrically conductive (normally metal) lines in baseplate structure 40 typically cross sealing area 40S. Where such crossings occur, these opaque lines are sufficiently thin that they do not significantly impact the local transfer of energy to material of outer wall 44 along edge sealing area 44S or to material of baseplate structure 40 along sealing area 40S according to the invention.

A getter (not shown) is typically situated either on the interior surface of baseplate structure 40 within sealing area 40S or on the interior surface of faceplate structure 42 within outer wall 44. As a result, the getter is located within the enclosure formed when baseplate structure 40 is sealed to composite structure 42/44/46. Alternatively, the getter may be situated in a thin auxiliary compartment mounted over the exterior surface of the baseplate and accessible to the enclosed region between plate structures 40 and 42 by way of one or more openings in the baseplate and/or, depending on the configuration of the auxiliary compartment, one or more openings in outer wall 44. In this case, the auxiliary compartment does not extend significantly above circuitry mounted over the exterior surface of the baseplate for controlling display operation, and thus does not create any significant difficulties in handing the flat-panel display.

The getter collects contaminant gases produced during, and subsequent to, the sealing of baseplate structure 40 to composite structure 42/44/46, including contaminant gases produced during operation of the hermetically sealed flat-panel display. Techniques for activating the getter are described in Cho et al, U.S. patent application Ser. No. 08/766435, filed Dec. 12, 1996, now U.S. Pat. No. 5,977,706, the contents of which are incorporated by reference to the extent not repeated herein.

Using a suitable alignment system (not shown), structures 40 and 42/44/46 are positioned relative to each other in the manner shown in FIG. 2*b*. This entails aligning sealing areas 40S and 44S (vertically in FIG. 2*b*) and bringing the interior surface of baseplate structure 40 into contact with the remote (upper in FIG. 2*b*) edges of spacer walls 46. The alignment is done optically in a non-vacuum environment, normally at room pressure, with alignment marks provided on plate structures 40 and 42. Specifically, baseplate structure 40 is optically aligned to faceplate structure 42, thereby causing baseplate sealing area 40S to be aligned to upper wall edge 44S.

In aligning structure 40 to structure 42/44/46, various techniques may be employed to ensure that spacer walls 46 stay in a fixed location relative to baseplate structure 40. For example, spacer walls 46 may go into shallow grooves (not shown) provided along the interior surface of structure 40. The grooves may extend below the general plane of the interior surface of structure 40 or may be provided in structures extending above the general plane of the interior surface of structure 40.

Regardless of how spacer walls 46 are secured to baseplate structure 40, spacer walls 46 are sufficiently taller than outer wall 44 that a gap 48 extends between aligned sealing areas 44S and 40S. At this stage of the sealing process, gap 48 normally extends along the entire (rectangular) length of sealing areas 40S and 44S. At the minimum, gap 48 extends along at least 50% of the sealing area length. The average height of gap 48 is normally in the range of 25–100 μm, typically 75 μm. The average gap height can readily be at least as much as 300 μm.

With structures 40 and 42/44/46 situated in the alignment system, a tacking operation is performed on the partially sealed flat-panel display as a preliminary step to sealing baseplate structure 40 to composite structure 42/44/46. The tacking operation serves to hold structure 40 in a fixed position relative to structure 42/44/46.

The tacking operation may be conducted in various ways. In the process of FIG. 2, the tacking operation is performed with a laser 50 that tacks structure 40 to structure 42/44/46 at several separate locations along aligned sealing areas 40S and 44S. See FIG. 2*c*. Inasmuch as the tacked portions of the flat-panel display are raised to elevated temperature during the tacking with laser 50, a global heating operation may be performed on structures 40 and 42/44/46 immediately before the laser tacking to raise structures 40 and 42/44/46 to a tacking bias temperature of 25° C.–300° C. The elevated temperature alleviates stress along the areas that are to be tacked, thereby reducing the likelihood of cracking.

Laser 50 is arranged so that its laser beam 52 passes through transparent material of baseplate structure 40 at each of the tack locations and enters corresponding upper portions of outer wall 44 while the aligned structure is in the non-vacuum environment. Light (photon) energy from beam 52 is transferred through baseplate structure 40 and locally to upper portions of outer wall 44 along sealing area 44S. This causes portions 44A of wall 44 to jump gap 48 and contact baseplate structure 40 at corresponding portions of sealing area 40S.

More particularly, outer wall 44 has corners at the edges of sealing area 44S. As the light energy of beam 52 is transferred locally to outer wall 44 at the tack locations, the portions of wall 44 immediately subjected to the light energy melt. Surface tension causes the so-melted portions of wall 44 to become round. The melted material at the corners of sealing area 44S moves towards the center of area 44S at the tack locations. In turn, this causes the material at the center of area 44S to move upward.

Gas contained in the melted portions of outer wall 44 or produced as a result of the melting may contribute to the upward expansion of wall 44 at the tack locations. Also, depending on the composition of wall 44 and on the conditions (e.g., wall temperature along sealing area 44S) of the local energy transfer, the material of wall 44 along edge 44S may undergo a phase change in which the density of that material decreases. The attendant increase in volume of the material of wall 44 along sealing area 44S then causes that material to expand toward sealing area 40S. In any event, upward-protruding portions 44A at the tack locations meet baseplate structure 40. After laser beam 52 moves beyond each upward-protruding tack portion 44A, that tack portion 44A cools down and becomes hard.

Laser 50 can be implemented with any of a number of different types of lasers provided that laser beam 52 has a major wavelength at which the material of outer wall 44 along sealing area 44S absorbs the light energy of beam 52 generated at that wavelength while the transparent material of baseplate structure 40 along sealing area 40S does not significantly absorb any of the light energy of beam 52 generated at that wavelength. For the case in which outer wall 44 is formed with frit such as the Ferro 2004 frit composite described above, the material of wall 44 along sealing area 44S absorbs light in the wavelength band extending from less than 0.2 μm to greater than 10 μm. This covers the entire visible light region running from 0.38 μm to 0.78 μm.

When the transparent material of structure 40 along sealing area 40S consists of glass, such as Schott D263 glass, that strongly transmits light whose wavelength is in the band extending from approximately 0.3 μm in the ultraviolet ("UV") region to approximately 2.5 μm in the infrared region, beam 52 has a major wavelength in the approximate range of 0.3–2.5 μm. As used here in connection with light transmission, "strongly" means at least 90% transmission. Subject to the preceding limitation, laser 50 can be a semiconductor diode laser, a carbon dioxide laser (with beam 52 offset by 90°), a UV laser, or a neodymium YAG laser. For example, when laser 50 is a diode laser, the beam wavelength is typically 0.85 μm. The power of beam 52 is typically 2–5 w.

Upward-protruding tack portions 44A firmly connect baseplate structure 40 to composite structure 42/44/46. Due to the formation of tack portions 44A, gap 48 is partially closed. Item 48A in FIG. 2*c* indicates the remainder of gap 48 after all of tack portions 44A have been produced. This completes the partial sealing of structure 40 to structure 42/44/46, subject to cooling the tacked display down to room temperature if a global heating operation was performed earlier on structures 40 and 42/44/46 to relieve stress during the laser tacking.

Figure 2D:
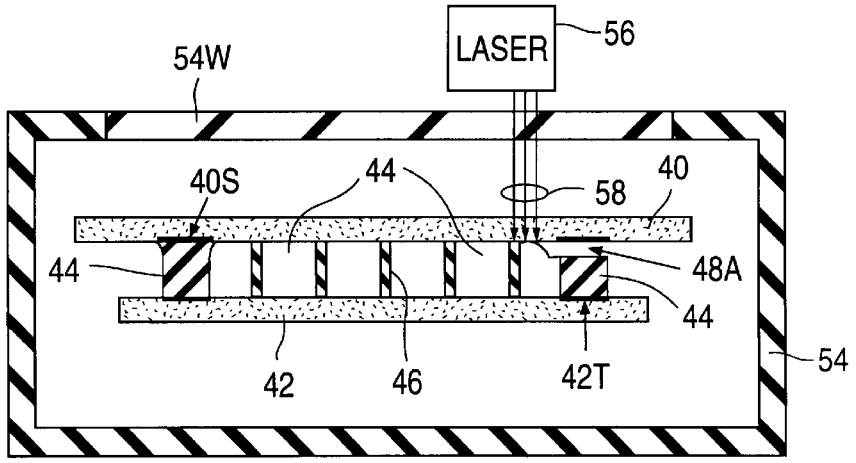
Figure 3:
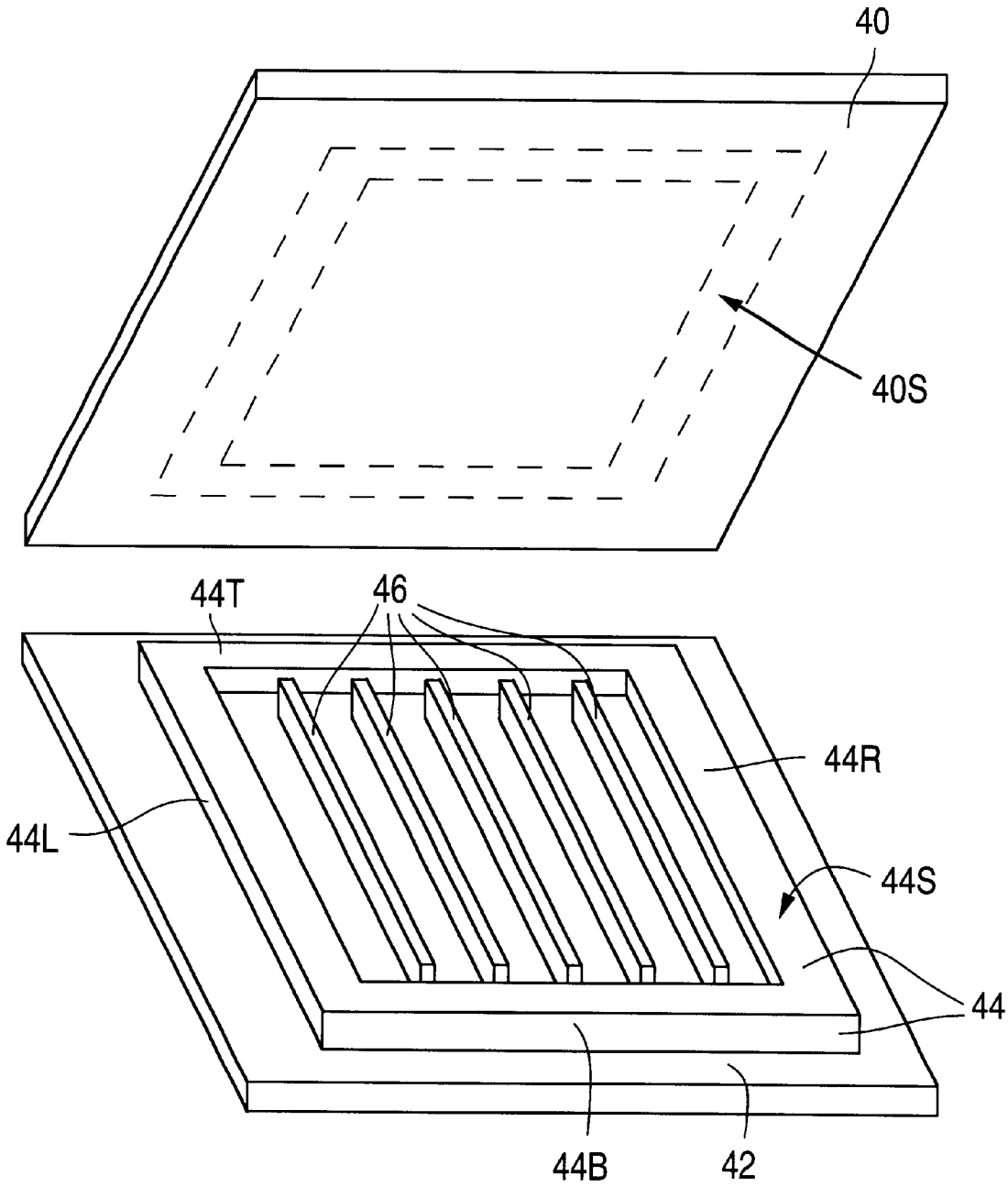
FIG. 3 is a perspective view of the flat-panel display of FIG. 2*a*, and also that of FIG. 4*a*.

The tacked/partially sealed flat-panel display is removed from the alignment system and placed in a vacuum chamber 54, as shown in FIG. 2*d*, for performing operations to complete the hermetic seal. Vacuum chamber 54 is then pumped down to a high vacuum level at a pressure no greater than $10^{-2}$ torr, typically $10^{-6}$ torr or lower. After optionally activating the (unshown) getter, the temperature of the flat-panel display is raised to a bias temperature of 200–350° C., typically 300° C. The temperature ramp-up is usually performed in an approximately linear manner at a ramp-up rate in the vicinity of 3–5° C./min. The elevated temperature reduces the likelihood of display cracking by alleviating stress in the material along sealing areas 40S and 44S.

The components of the tacked flat-panel display outgas during the temperature ramp-up and during the subsequent "soak" time at the bias temperature prior to display sealing. The gases, typically undesirable, that were trapped in the display structure enter the unoccupied part of vacuum chamber 54, causing its pressure to rise. To remove these gases from the enclosure that will be produced when baseplate structure 40 is fully sealed to composite structure 42/44/46, the vacuum pumping of chamber 54 is continued during the sealing operation in chamber 54. If activated, the (unshown) getter contained in the partially completed enclosure assists in collecting undesired gases during the temperature ramp-up and subsequent soak.

A laser 56 that produces a laser beam 58 is located outside vacuum chamber 54. Laser 56 is arranged so that beam 58 can pass through a (transparent) window 54W of chamber 54 and then through transparent material of baseplate structure 40. Window 54W typically consists of quartz.

Laser 56 can be any of a number of different types of lasers provided that laser beam 58 has a major wavelength at which neither window 54W in vacuum chamber 54 nor the transparent material of baseplate structure 40 along sealing area 40S significantly absorbs any of the light energy of beam 58 moving at that wavelength. Quartz, typically used for window 54W, strongly transmits light whose wavelength is in the band extending from 0.2 μm to nearly 3 μm. When the transparent material of baseplate structure 40 along sealing area 40S consists of glass that strongly transmits light in the wavelength band from approximately 0.3 μm to approximately 2.5 μm, the glass transmission band is included within the quartz transmission band. Since beam 58 must pass through both quartz and glass in this example, beam 58 has a major wavelength in the approximate range of 0.3–2.5 μm, just as with beam 52 of laser 50 used in the tacking operation. Accordingly, laser 56 can be any of the laser types described above for laser 50. In a typical case where laser 56 is a diode laser, beam 58 has a major wavelength of 0.85 μm. The power of beam 58 is typically 2–5 w.

With the pressure of vacuum chamber 56 at a high vacuum level and with the partially sealed flat-panel display at a bias temperature in the above-mentioned range, laser beam 58 and the display are moved relative to each other in such a way that beam 58 substantially fully traverses aligned sealing areas 40S and 44S. That is, beam 58 starts at one place along sealing areas 40S and 44S, and (relative to the display) moves from that place in a rectangular pattern until reaching the original place. FIG. 2*d* illustrates how the flat-panel display appears at an intermediate point during the traversal of beam 58 along sealing areas 40S and 44S. Laser beam 58 typically moves at rate in the vicinity of 1 mm/sec relative to the display. If desired, beam 58 can skip tack portions 44A.

As laser beam 58 traverses sealing areas 40S and 44S, light energy is transferred through baseplate structure 40 and locally to upper material of outer wall 44 along gap remainder 48A. The local energy transfer causes the material of outer wall 44 subjected to the light energy to melt and jump remaining gap 48A. The gap-jumping mechanism here is basically the same as the gap-jumping mechanism that occurred during the earlier gap-jumping tack operation. The melted wall material along sealing area 44S hardens after beam 58 passes.

Gap remainder 48A progressively closes during the sealing operation with laser 56. As remaining gap 48A closes, the gases present in the enclosure being formed by the sealing of outer wall 44 to baseplate structure 40 escape from the enclosure through the progressively decreasing remainder of gap 48A. Full closure of gap remainder 48A occurs when beam 58 completes the rectangular traversal of sealing areas 40S and 44S.

After the sealing operation with laser 56 is complete and while the sealed flat-panel display is approximately at the bias temperature, the (unshown) getter is activated (re-activated if activated prior to the sealing operation). The temperature of the display is then returned to room temperature. The term "room temperature" here means the external (usually indoor) atmospheric temperature, typically in the vicinity of 20–25° C.

The cool down to room temperature is controlled so as to avoid having the instantaneous cool-down rate exceed a value in the range of 3–5° C./min. Inasmuch as the natural cool-down rate at the beginning of the thermal cool-down cycle normally exceeds 3–5° C./min., heat is applied during the initial part of the cycle to maintain the cool-down rate approximately at the selected value in the range of 3–5° C./min. The heating is progressively decreased until a temperature is reached at which the natural cool-down rate is approximately at the selected value after which the flat-panel display is typically permitted to cool down naturally at a rate that progressively decreases to zero. Alternatively, a forced cool down can be employed during this part of the cool-down cycle to speed up the cool down.

Figure 2E:
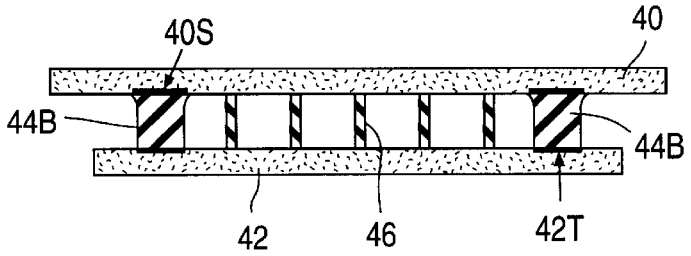
Figure 2B:
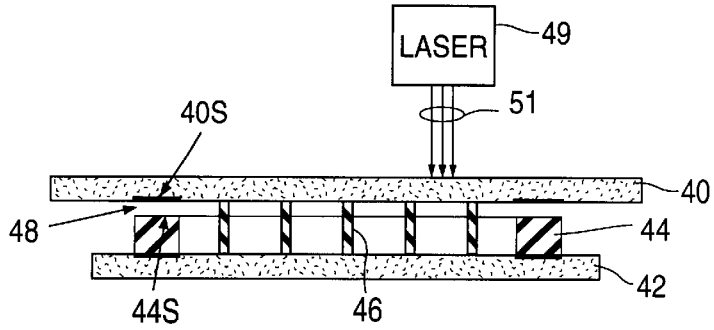
Figure 2C:
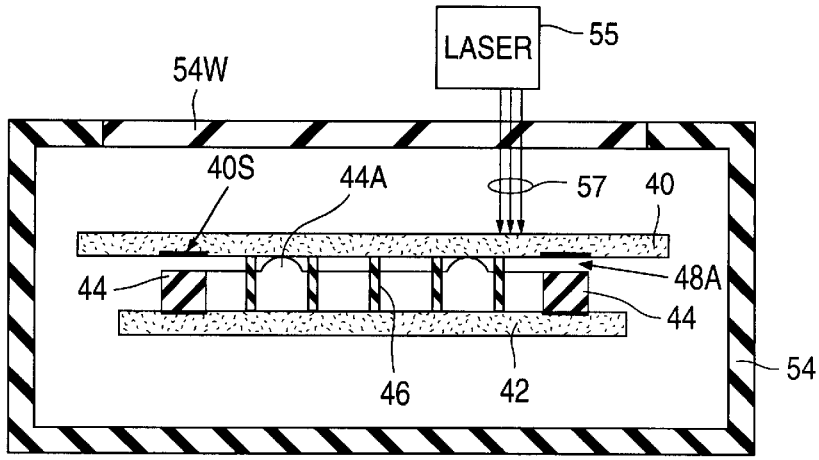
Figure 2C:
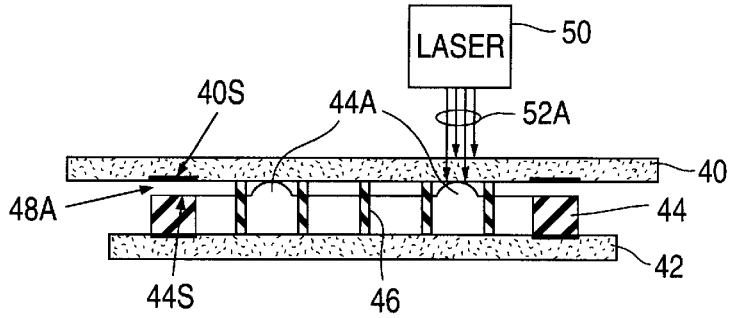
Figure 2D:
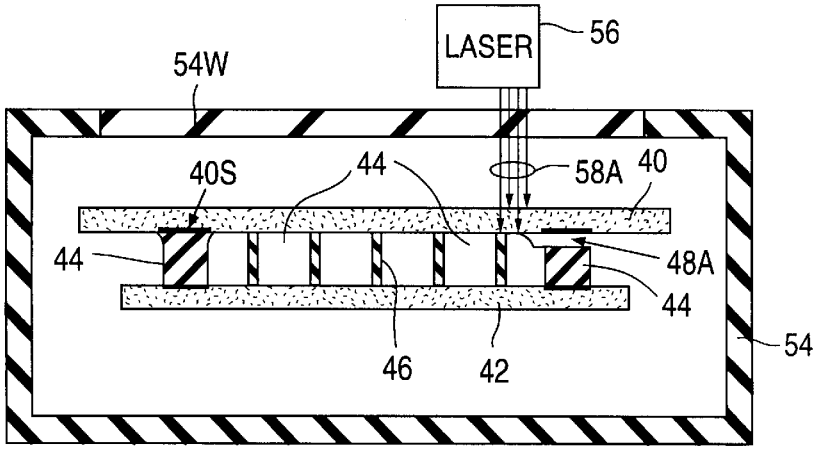

The chamber pressure is subsequently raised to room pressure, and the fully sealed flat-panel display is removed from vacuum chamber 54. The term "room pressure" here means the external atmospheric pressure, normally in the vicinity of 1 atm. depending on the altitude. Alternatively, the chamber pressure can be raised to room pressure before cooling the sealed display down to room temperature. In either case, FIG. 2*e* illustrates the resulting structure. Item 44B in the sealed flat-panel display indicates the sealed shape of outer wall 44.

The getter is re-activated after the sealed flat-panel display is returned to room temperature. The getter re-activation can be performed while the display is in vacuum chamber 54 or after removing the display from chamber 54.

Instead of performing the final laser seal of FIG. 2*d* entirely in a high vacuum environment, the final gap-jumping laser seal of composite structure 42/44/46 to baseplate structure 40 can be initiated in a chemically neutral (i.e., largely non-reactive) environment consisting largely of dry nitrogen or an inert gas such as argon. The final gap jumping seal is then completed in a high vacuum environment. Use of such a combined neutral-environment/vacuum hybrid technique takes advantage of the fact that frit sealed in dry nitrogen or an inert gas has a lower porosity, and thus a higher density, than otherwise identical frit sealed in a high vacuum. Consequently, the portion of the frit in outer wall 44 sealed to baseplate structure 40 in the neutral environment by using the combined neutral-environment/vacuum hybrid technique is less likely to develop leaks, thereby improving the overall hermeticity of the sealed flat-panel display. Also, frit sealing in dry nitrogen or an inert gas provides good wetting and low-permitivity corner seals, so as to further improve the overall hermeticity.

The final sealing operation in the neutral-environment/vacuum hybrid alternative begins with the tacked structure of FIG. 2*c* in which gap remainder 48A is present between baseplate structure 40 and composite structure 42/44/46. The tacked structure is placed in vacuum chamber 54. The pressure in chamber 54 is reduced to a low value, typically a high vacuum level of $10^{-2}$ torr or less. Reducing the pressure to a high vacuum level inhibits corrosion of the tacked structure. The partially sealed flat-panel display is heated up to a bias temperature of 200° C.–350° C., typically 300° C., in the manner described above. Outgassing again occurs during the temperature ramp-up.

Dry nitrogen or argon is back filled into vacuum chamber 54, raising the chamber pressure to 300–760 torr, typically 760 torr (1 atm.) when chamber 54 is filled with dry nitrogen. Laser 56 is operated in such a manner that laser beam 58 traverses a substantial part of the (annular) length of aligned sealing areas 40S and 44S. Although significant improvement can be achieved when laser beam 58 traverses as little as 10% of the sealing area length, beam 58 normally traverses at least 25%, preferably at least 50%, of the sealing area length. Gap jumping that results from the local transfer of light energy through the outer-wall material along the portion of wall sealing area 44S traversed by beam 58 while structures 40 and 42/44/46 are in the dry nitrogen or argon environment causes baseplate structure 40 to become sealed to outer wall 44 along the portion of sealing area 44S traversed by beam 58.

Referring to FIG. 3, outer wall 44 consists of a left sub-wall 44L, a top sub-wall 44T, a right sub-wall 44R, and a bottom sub-wall 44B. Laser beam 58 normally traverses the portion of wall sealing 44S along the entire length of at least two adjoining ones of sub-walls 44L, 44T, 44R, and 44B—e.g., adjoining sub-walls 44L and 44T—while structures 40 and 42/44/46 are in the dry nitrogen or argon environment. Preferably, beam 58 traverses the portion of sealing area 44S along the entire length of three of sub-walls 44L, 44T, 44R, and 44B, including all four corners of outer wall 44, during the neutral-environment step of the gap-jumping laser seal operation.

When the partial sealing in dry nitrogen or argon is complete, vacuum chamber 54 is pumped down to a high vacuum level at a pressure no greater than $10^{-2}$ torr, typically $10^{-6}$ torr or lower. After reaching the desired vacuum level, the getter may be activated to collect undesired gases. The remainder of the sealing operation is completed in the manner described above except that laser beam 58 does not traverse significantly beyond the unsealed portion of the length of sealing areas 40S and 44S. FIG. 2*e* again illustrates the finally sealed flat-panel display after the temperature is returned to room temperature, the pressure in chamber 58 is returned to room pressure, and the flat-panel display is removed from chamber 54.

As part of the laser tacking and final gap jumping laser sealing operations, the material of baseplate structure 40 along sealing area 40S can be locally heated to a temperature close to the melting temperature of the material of outer wall 44 along edge sealing area 44S. Doing so provides stress relief in the sealed material along the interface between baseplate structure 40 and outer wall 44.

Raising the material of baseplate structure 40 along sealing area 40S to a temperature close to the melting temperature of the material of outer wall 44 along sealing area 44S is normally performed when the flat-panel display is already at the desired bias temperature of 200–350° C. Consequently, stress is relieved in the entire display at a temperature high enough to cause outgassing of gases that might otherwise outgas into the finally sealed enclosure during display operation and cause display degradation without the necessity for expending the large amount of time that would be involved in raising the entire display to the considerably higher melting temperature of outer wall 44.

Some additional outgassing does occur from the baseplate structure material along sealing area 40S when that material is raised to the melting temperature of the outer wall material along edge sealing area 44S. However, the combination of heating the entire display to a bias temperature of 200–350° C. and then locally raising the baseplate structure material along sealing area 40S to the higher melting temperature of the outer wall material avoids raising other parts of the display to a high temperature that could cause unnecessary outgassing from those other parts of the display and could damage active elements in the display. The combination of globally heating the entire display to a moderately high bias temperature and locally heating the baseplate structure material along sealing area 40S to a higher temperature close to the melting temperature of the outer wall material along sealing area 44S is thus highly beneficial.

FIGS. 2*b and 2*c illustrate a technique for locally heating the material of baseplate structure 40 along sealing area 40S to a temperature close to the melting temperature of the material of outer wall 44 along sealing area 44S. After the positioning step of FIG. 2*b* is completed but before upward-protruding tack portions 44A are created by laser 50 in FIG. 2*c*, a laser 49 is employed to transfer light energy locally to portions of the baseplate structure material along sealing area 40S opposite the intended locations for tack portions 44A as indicated in FIG. 2*b. Laser 49 generates a laser beam 51 that raises these portions of the baseplate structure material to a selected tacking-assist temperature close to the melting temperature of the outer wall material along sealing area 44S. The tacking-assist temperature typically is lower than the melting temperature of the outer wall material along sealing area 44S. For simplicity, laser 49 may also be operated to raise the remainder of the baseplate structure material along sealing area 40**S to the tacking-assist temperature.

Laser beam 51 has a major wavelength outside the transmission band of the transparent material of baseplate structure 40 along sealing area 40S. For example, when outer wall 44 consists of frit that absorbs light whose wavelength is in the band running from less than 0.2 $\mu$m to greater than 10 $\mu$m while the transparent material of baseplate structure 40 along sealing area 40S consists of glass that strongly transmits light in the wavelength band running approximately from 0.3 $\mu$m to 2.5 $\mu$m, laser beam 51 has a major wavelength in the lower domain running from less than 0.2 $\mu$m to approximately 0.3 $\mu$m or in the upper domain running from approximately 2.5 $\mu$m to greater than 10 $\mu$m. In addition, beam 51 does not have any major wavelength within the transmission band of the transparent material of baseplate structure 40 along sealing area 40S—i.e., not in the approximate 0.3-$\mu$m-to-2.5-$\mu$m wavelength band when the transparent baseplate structure material along sealing area 40S consists of glass such as Schott D263 glass.

After the laser tacking step of FIG. 2*c* has been completed and the tacked flat-panel display has been placed in vacuum chamber 54 but before gap remainder 48A has been bridged by local energy transfer from laser 56 in FIG. 2*d*, a laser 55 is utilized to transfer light energy locally through window 54W of chamber 54 to portions of the material of baseplate structure 40 along sealing area 40S as shown in FIG. 2*c. Laser 55 generates a laser beam 57 that raises the baseplate structure material along sealing area 40S to a selected sealing-assist temperature close to the melting temperature of the outer wall material. The sealing-assist temperature typically is approximately equal to the melting temperature of the outer wall material along sealing area 44S. As with laser beam 58 of laser 56, laser beam 57 passes through chamber window 54W without significant absorption. Likewise, laser 55 may be operated so that beam 57 skips the portions of the baseplate structure material opposite tack portions 44**A.

Laser beam 57 has a major wavelength within the transmission band of chamber window 54W but outside the transmission band of the transparent material of baseplate structure 40 along sealing area 44S. For example, when outer wall 44 consists of frit that absorbs light in the 0.2-$\mu$m-to-10-$\mu$m wavelength band while window 54W consists of quartz that strongly transmits light whose wavelength is in the band extending approximately from 0.2 $\mu$m to 3 $\mu$m, and the transparent material of baseplate structure 40 along sealing area 40S consists of glass that strongly transmits light in the approximate 0.3-$\mu$m-to-2.5-$\mu$m wavelength band, beam 57 has a major. wavelength in the approximate lower domain of 0.2–0.3 $\mu$m or in the approximate upper domain of 2.5–3 $\mu$m.

If the preceding wavelength domains for laser beam 57 are unduly narrow, the quartz typically used for window 54W can be replaced with transparent material, such as zinc selenide, that strongly transmits light whose wavelength extends from approximately 0.2 $\mu$m to greater than 10 $\mu$m. Beam 57 can then have a major wavelength in the approximate upper domain running from 2.5 μm to greater than 10 μm. As with laser beam 51, beam 57 normally does not have a major wavelength within the transmission band of the transparent material of baseplate structure 40 along sealing area 40S—i.e., not in the approximate 0.3-μm-to-2.5-μm wavelength band when the transparent material of baseplate structure 40 along sealing area 40S is formed with glass such as Schott D263 glass.

Lasers 49 and 55 can be replaced with focused lamps that provide light in wavelength bands that fall into specified wavelength domains but do not provide light in wavelength bands outside the specified domains. For example, when window 54W consists of quartz while the materials of baseplate structure 40 and outer wall 44 along sealing areas 40S and 44S have the exemplary transmission/absorption characteristics given above, laser 49 can be replaced with a focused lamp that transmits light across a wavelength band falling into the lower wavelength domain from less than 0.2 μm approximatly 0.3 μm and/or the upper wavelength domain from approximatly 2.5 μm to greater than 10 μm. Laser 55 can then be replaced with a focused lamp that transmits light in a wavelength band falling into the lower wavelength domain of 0.2–0.3 μm or into the approximate upper wavelength domain of 2.5–3 μm. If window 54 is formed with zinc selenide rather than quartz, the upper domain for the wavelength band of the focused lamp that replaces laser 55 is approximately 2.5–10 μm. Filters that strongly attenuate wavelengths (frequencies) in selected bands can be employed on the focused lamps to remove light in undesired wavelength bands if the focused lamps do not already do so naturally.

FIGS. 2*c*' and 2*d*' illustrate another technique for locally heating material of baseplate structure 40 along sealing area 40S to a temperature close to the melting temperature of the material of outer wall 44 along edge sealing area 44S. The difference between the technique of FIGS. 2*c*' and 2*d*' and the technique of FIGS. 2*b and 2*c in which the local heatings of the baseplate structure material along sealing area 40S are performed respectively before utilizing lasers 50 and 56 to locally heat the material of outer wall 44 along sealing area 44S is that the local heatings of the baseplate structure material along sealing area 40S in the technique of FIGS. 2*c*' and 2*d*' are performed respectively at the same times that lasers 50 and 56 are employed to locally heat the outer wall material along sealing area 44S. In the process of FIG. 2, the step of FIG. 2*c*' thus replaces the step of FIG. 2*c*, while the step of 2*d*' similarly replaces the step of FIG. 2*d*.

Laser 50, used in the tacking operation, generates a laser beam 52A at wavelengths falling into two or more distinct tacking wavelength domains. See FIG. 2*c*'. The energy of beam 52A in one of these tacking wavelength domains locally raises the temperature of the portions of the baseplate structure material along sealing area 40S opposite the intended locations for tack portions 44A to a selected tacking-assist temperature close to the melting temperature of the outer wall material along sealing area 44S. The tacking-assist temperature again typically is lower than the melting temperature of the outer wall material along sealing area 44S.

At the same time that the beam energy in this tacking wavelength domain raises portions of baseplate structure 40 along sealing area 40S to the tacking-assist temperature, the energy of laser beam 50A in another of the wavelength domains is locally transferred to portions of the outer wall material along sealing area 44S to cause gap jumping that produces tack portions 44A. The amount of light energy locally transferred to the baseplate structure material at the intended tack locations relative to the amount of light energy simultaneously locally transferred to the outer wall material at the tack locations is controlled by suitably choosing the wavelength domains, including the power provided in those wavelength domains, for beam 52A relative to the composition of the materials of baseplate structure 40 and outer wall 44 at the tack locations. In this way, the value of the tacking-assist temperature is controlled relative to the melting temperature of the outer wall material along edge 44S.

Consider the exemplary display values given above in which outer wall 44 consists of frit that absorbs light energy in the wavelength band running from less than 0.2 μm to greater than 10 μm while the baseplate structure material along sealing area 44S consists of glass that transmits light in the domain running approximately from 0.3 μm to 2.5 μm. In this case, laser beam 52A has (a) a first major wavelength in the approximate domain of 0.3–2.5 μm for local heating portions of the outer wall material to produce tack portions 44A and (b) another major wavelength in the lower domain extending from less than 0.2 μm to approximately 0.3 μm or in the upper domain extending from approximately 2.5 μm to greater than 10 μm for heating the portions of the baseplate structure material opposite tack portions 44A to the tacking-assist temperature. These tacking wavelength domains are distinct even though they share boundaries.

Laser 56, employed in the final gap jumping laser seal while the tacked flat-panel display is in vacuum chamber 54, generates a laser beam 58A at wavelengths that fall into two or more distinct sealing wavelength domains bounded by the ends of the wavelength transmission band of chamber window 54W. The energy of laser beam 58A in one of these sealing wavelength domains locally raises the temperature of the baseplate structure material along sealing area 40S to a selected sealing-assist temperature close to the melting temperature of the outer wall material along sealing area 44S. The sealing-assist temperature again typically is approximately equal to the melting temperature of the outer wall material along sealing area 44S.

At the same time that the beam energy in this wavelength domain locally raises the baseplate structure material along sealing area 44S to the sealing-assist temperature, the energy of laser beam 58A in another of the selected wavelength domains is locally transferred to the outer wall material along sealing area 44S to produce gap jumping that fully closes gap remainder 48A. As in the tacking operation of FIG. 2*c*', the amount of light energy locally transferred to the baseplate structure material along sealing area 40S relative to the amount of light energy locally transferred to the outer wall material along sealing area 44S is controlled by suitably choosing the wavelength domains, including the power provided in those wavelength domains, for beam 58A relative to the compositions of the materials of baseplate structure 40 and outer wall 44 along gap remainder 48A. This enables the value of the sealing-assist temperature to be controlled relative to the melting temperature of the outer wall material along edge 44S. Laser 56 may be operated so as to skip tack portions 44A and the portions of baseplate structure 40 opposite portions 44A.

Consider the exemplary display/chamber-window values given above in which chamber window 54W is formed with quartz that strongly transmits light in the wavelength band running approximately from 0.2 μm to 3 μm while outer wall 44 is formed with frit that absorbs light in at least the 0.2-μm-to-10-μm wavelength band, and the material of baseplate structure along sealing area 44S is formed with glass that strongly transmits light in the approximate 0.3-μm-to-2.5-μm wavelength band. Laser beam 58A then has one major wavelength in the approximate domain of 0.3–2.5 μm for locally heating the outer wall material along sealing area 44S to close gap 48A by gap jumping and (b) another major wavelength in the lower domain extending approximately from 0.2 μm to 0.3 μm or in the upper domain extending approximately from 2.5 μm to 3 μm for heating the baseplate structure material along sealing area 40S to the sealing-assist temperature.

If the preceding wavelength domains for heating the baseplate structure material along sealing area 44S to the sealing-assist temperature are unduly narrow, the quartz typically used in chamber window 54W can again be replaced with transparent material, such as zinc selenide, that strongly transmits light at least in the 0.2-μm-to-10-μm wavelength band. The upper wavelength domain for heating the baseplate structure material along sealing area 44S to the sealing-assist temperature can then be extended to 2.5–10 μm.

Laser 50 can be replaced with a focused lamp that generates light in wavelength bands that fall into the tacking wavelength domains given above for the step of FIG. 2*c*'. Laser 56 can likewise be replaced with a focused lamp that generates light in wavelength bands that fall into the sealing wavelength domains given above for the step of FIG. 2*d*'. Wavelength (frequency) filters can again be utilized on the focused lamps to remove light in undesired wavelength bands.

The final gap-jumping laser seal of FIG. 2*d*' can be performed using a combined neutral-environment/vacuum hybrid technique in the same manner as described above for the final laser seal of FIG. 2*d*, except that laser beam 58 in FIG. 2*d* is replaced with laser beam 58A in FIG. 2*d*'. Also, the local heating of the baseplate structure material along sealing area 40S to the sealing-assist temperature in FIG. 2*c can be initiated in dry nitrogen or an inert gas such as argon, and completed in a high vacuum environment in the same manner as described above for the process of FIG. 2***d*. That is, the following procedure can be utilized while the partially finished flat-panel display is in vacuum chamber 54: (a) at least part of the baseplate structure material along sealing area 40S is locally heated to the tacking-assist temperature in dry nitrogen or argon, (b) part of gap remainder 48A is bridged by local energy transfer in dry nitrogen or argon, (c) the baseplate structure material along at least the remainder of gap remainder 48A is locally heated to the sealing-assist temperature in a high vacuum environment, and (d) the remainder of remaining gap 48A is bridged by local energy transfer in the high vacuum environment.

FIGS. 4*a*–4*e* (collectively "FIG. 4") illustrate a variation of the sealing process of FIG. 2 in which the tacking operation to hold baseplate structure 40 in a fixed position relative to composite structure 42/44/46 is performed with a tacking structure separate from sealing areas 40S and 44S. The starting point for the process of FIG. 4 is typically the structure of FIG. 2*a*, repeated here as FIG. 4*a*. At the point shown in FIG. 4*a*, outer wall 44 has been sealed (or joined) to faceplate structure 42 according to a technique of the type described above for the process of FIG. 2. As with FIG. 2*a*, FIG. 3 illustrates a perspective view of the structure of FIG. 4*a*.

The tacking structure typically consists of several laterally separated tack posts, each consisting of a pillar 60 and an overlying piece 62 of tack glue. See FIG. 4*b*. Tack posts 60/62 are formed on the interior surface of faceplate 42, normally outside outer wall 44. For example, one tack post 60/62 is typically provided outside of each of the four sub-walls of outer wall 44.

Tack posts 60/62 are created by bonding pillars 60 to the interior surface of faceplate structure 42 and then depositing pieces 62 of tack glue on top of pillars 60. Pillars 60 typically consist of stained aluminum oxide. The tack glue typically consists of a UV-curable polymer. The tack glue can alternatively be a material curable with a laser beam directed at tack pieces 62 or directed at pillars 60, where thermal energy transfer from pillars 60 to tack pieces 62 causes the tack glue to set. The tack glue can also be a material curable by blowing hot gas over tack pieces 62.

Figure 4A:
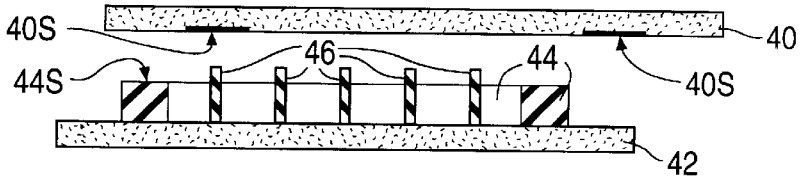
FIGS. 4*a*–4*e* are cross-sectional views representing steps in a process for sealing a flat-panel display using a positioning structure and local energy transfer to produce gap jumping in accordance with the invention.
Figure 4B:
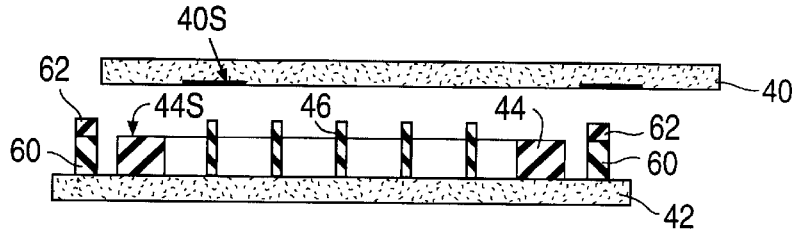
Figure 4C:
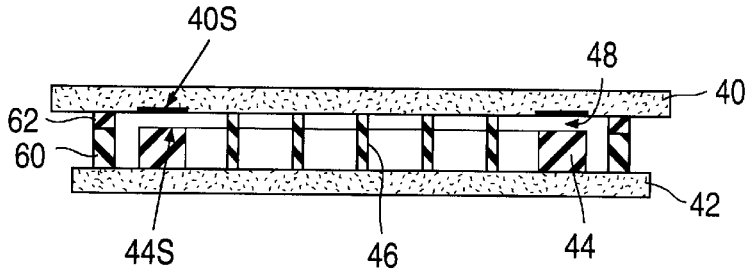

Baseplate structure 40 and composite structure 42/44/46/60/62 are subsequently aligned to one another as shown in FIG. 4*c*. As in the process of FIG. 2, the alignment in the process of FIG. 4 entails aligning baseplate sealing area 40S to wall-edge sealing area 44S (vertically in FIG. 4*c*) and then bringing the interior surface of baseplate structure 40 into contact with the upper edges of spacer walls 46. Likewise, the alignment is done in a non-vacuum environment, normally at room pressure, using alignment marks provided on plate structures 40 and 42 for optically aligning them so as to align sealing areas 40S and 44S.

As spacer walls 46 contact baseplate structure 40, tack glue pieces 62 contact structure 40 to bond tack posts 60/62 to structure 40. The composite height of tack posts 60/62 is chosen as to ensure that glue pieces 62 are compressed slightly upon coming into contact with baseplate structure 40. If glue pieces 62 do not become bonded to structure 40 by simply allowing a suitable drying time, a separate operation may be performed to create the bond. At the end of the alignment/bonding operation, gap 48 exists between sealing areas 40S and 44S as shown in FIG. 4*c*. As in the process of FIG. 2, gap 48 in the process of FIG. 4 normally extends along the entire length of sealing areas 40S and 44S.

The alignment of baseplate structure 40 to composite structure 42/44/46/60/62 and the bonding of tack posts 60/62 to structure 40 is performed in a suitable alignment system (not shown). Depending upon the characteristics of the tack glue, composite structure 42/44/46/60 may be placed in the alignment system before or after depositing glue pieces 62 on pillars 60.

Figure 4D:
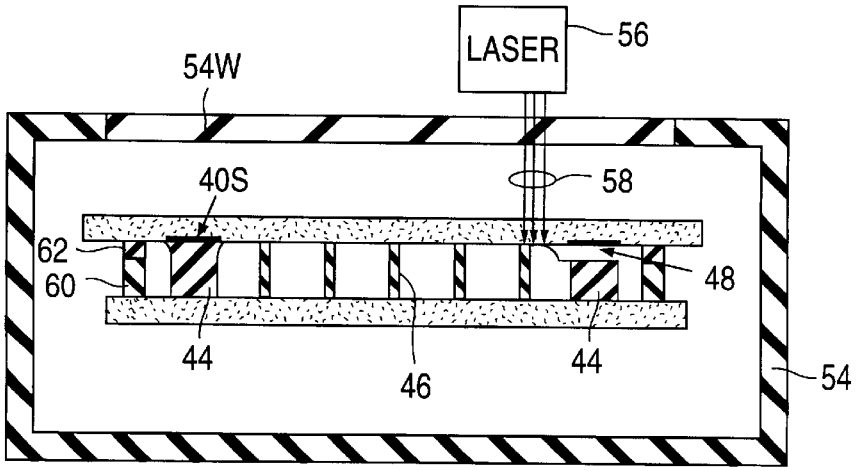

The tacked structure is removed from the alignment system and placed in vacuum chamber 54 as indicated in FIG. 4*d*. Vacuum chamber 54 is pumped down to a high vacuum level at a pressure no greater than $10^{-2}$ torr, again typically $10^{-6}$ torr or lower. Baseplate structure 40 is then sealed to composite 42/44/46/60/62 in substantially the same manner described above for sealing baseplate structure 40 to composite structure 42/44/46 in the process of FIG. 2. That is, with the structure raised to a bias temperature of 200° C.–350° C., typically 300° C., beam 58 of laser 56 passes through transparent material of baseplate structure 40 and fully traverses aligned sealing areas 40S and 44S, causing upper material of outer wall 44 to bridge gap 48. FIG. 4*d* indicates an intermediate point during the traversal of beam 58 along sealing areas 40S and 44S.

The sealing operation in vacuum chamber 54 according to the process of FIG. 4 is normally substantially identical to the sealing operation in vacuum chamber 54 according to the process of FIG. 2 except that upward-protruding portions 44A of outer wall 44 in the process of FIG. 2 are not present in the process of FIG. 4 and thus cannot be skipped over during the final vacuum seal. Consequently, the sealed flat-panel display of FIG. 4*d* is cooled down to room temperature in the manner specified for the process of FIG. 2, and the pressure in vacuum chamber 54 is raised to room pressure. FIG. 4*e* depicts the completely sealed flat-panel display after it is removed from chamber 54. Item 44B again represents the sealed shape of outer wall 44.

Figure 4E:
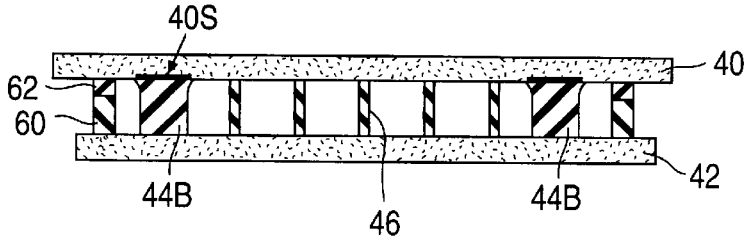

As in the process of FIG. 2 where the final laser seal of FIG. 2*d* can be alternatively performed by a neutral-environment/vacuum hybrid technique, the final gap-jumping laser seal of composite structure 42/44/46 to baseplate structure 40 in FIG. 4*d* can be initiated in a neutral-environment (e.g., dry nitrogen or an inert gas such as argon) and completed in a high vacuum environment. Except for differences that result from using tack posts 60/62 in the process of FIG. 4 rather than laser-produced tack portions 44A in the process of FIG. 2, the neutral-environment/vacuum hybrid alternative is applied to the process of FIG. 4 in the same manner as to the process of FIG. 2. Accordingly, FIG. 4*e* depicts how the finally sealed flat-panel display appears when the neutral-environment/vacuum alternative is applied to the process of FIG. 4. The variation of FIG. 2*c or 2***d*' can also be applied to the process of FIG. 4.

FIGS. 5*a*–5*e* (collectively "FIG. 5") depict a variation of the process of FIG. 2 in which a double-laser technique is employed with gap jumping in accordance with the invention to hermetically seal a flat-panel display of the type described above. The double-laser technique can be implemented in various ways. While a tacking structure similar to tack posts 60/62 in the process of FIG. 4 can be employed to place the components of the flat-panel display in a fixed position relative to one another before performing the double-laser sealing technique, the components of the flat-panel display can also be tacked together using a double-laser tacking technique in accordance with the invention. The latter tacking technique is shown in FIG. 5.

Figure 5A:
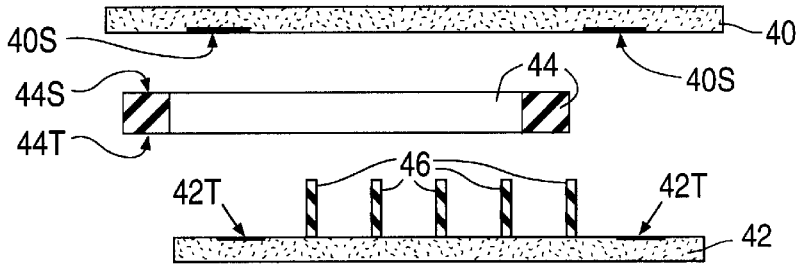
FIGS. 5*a*–5*e* are cross-sectional views representing steps in a process for sealing a flat-panel display using a double-laser system to produce gap jumping in accordance with the invention.

Beginning at the stage shown in FIG. 5*a*, baseplate structure 40, faceplate structure 42, and outer wall 44 are all separate from one another. Spacer walls 46 are, however, mounted on faceplate structure 42.

Baseplate structure 40 is to be sealed to outer wall 44 along baseplate sealing area 40S and upper wall-edge sealing area 44S. Faceplate structure 42 is to be sealed to outer wall 44 along lower wall-edge sealing area 44T and faceplate sealing area 42T. Dark line are again employed in FIG. 5 to identify sealing areas 40S and 42T. Faceplate structure 42 is transparent along sealing area 42T.

Figure 5B:
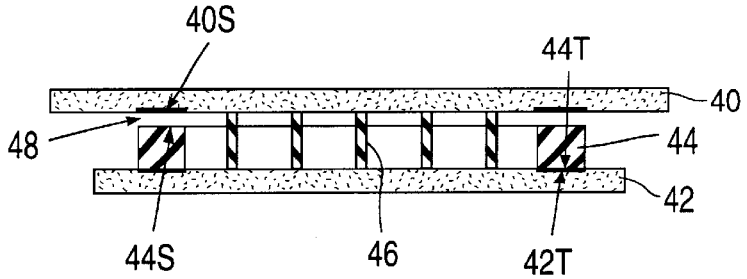

Baseplate structure 40, composite structure 42/46, and outer wall 44 are aligned to one another as shown in FIG. 5*b* using a suitable alignment system (not shown). This entails (a) aligning wall-edge sealing area 44T to faceplate sealing area 42T (vertically in FIG. 5*b*) and bringing the lower edge of outer wall 44 into contact with the interior surface of faceplate structure 42 and (b) aligning baseplate sealing area 40S to wall-edge sealing 44S (again vertically in FIG. 5*b*) and bringing the interior surface of baseplate structure 40 into contact with spacer walls 46. The alignment step is done in a non-vacuum environment, normally at room pressure.

Spacer walls 46 are again taller than outer wall 44. Consequently, gap 48 exists between sealing areas 40S and 44S. Again, the average gap height is in the range of 25–100 $\mu$m, typically 50 $\mu$m. Outer wall 44 is situated substantially flush on faceplate structure 42. No significant gap exists between sealing areas 44T and 42T.

With the aligned structure in the alignment system, an optional heating operation is performed as described above in the process of FIG. 2 to alleviate stress at the areas to be tacked. A tacking operation is then performed with lasers 70 and 72 to place plate structures 42 and 40 in a fixed position relative to outer wall 44. See FIG. 5*c*.

The tacking operation is performed at several locations along aligned sealing areas 44T and 42T and at several locations along aligned sealing areas 40S and 44S. Lower laser 70 is arranged so that its laser beam 74 passes through transparent material of faceplate structure 42 at the faceplate tack locations. Upper laser 72 is similarly arranged so that its laser beam 76 passes through transparent material of baseplate structure 40 at the baseplate tack locations.

Both the transparent material of baseplate structure 40 along sealing area 40S and the transparent material of faceplate structure 42 along sealing area 42T preferably consist of glass that transmits light in the approximate wavelength band of 0.3–2.5 $\mu$m. Accordingly, each of lasers 70 and 72 can be implemented with any of the lasers described above for implementing laser 50 in the process of FIG. 2. Likewise, the power of each of laser beams 74 and 78 is 2–5 w.

Figure 5C:
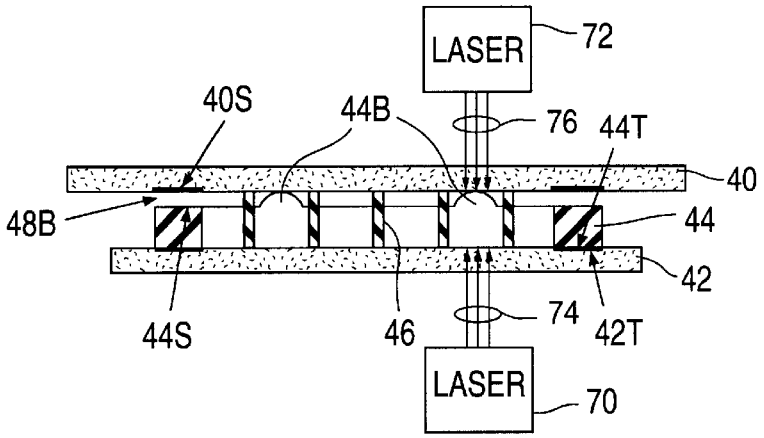

The tacking operation is performed with each of lasers 70 and 72 in basically the same way as the single-laser tacking operation is conducted in the process of FIG. 2. The light energy of upper laser 72 is locally transferred through baseplate structure 40 to upper portions of outer wall 44 at the baseplate tack locations along sealing area 44S. The upper portions of wall 44 subjected to laser beam 76 heat up and melt. This melted material then protrudes upward to form portions 44B that bridge gap 48 at the tack locations along sealing area 44S. Tack portions 44B firmly connect baseplate structure 40 to outer wall 44. Item 48B in FIG. 5*c* is the remainder of gap 48.

The light energy of laser beam 74 is locally transferred through faceplate structure 42 to lower portions of outer wall 44 at the faceplate tack locations along sealing area 44T. The lower portions of wall 44 subjected to beam 74 heat up and melt. The melted lower wall material then bonds outer wall 44 to faceplate 42 at the faceplate tack locations along sealing area 42T. Lasers 70 and 72 typically operate simultaneously and in tandem as they move (relative to the display) from one corresponding pair of tack locations along sealing areas 44S and 44T to another pair of corresponding tack locations. After all the tacks have been created, the tacked structure is, as necessary, cooled down to room temperature.

Figure 5D:
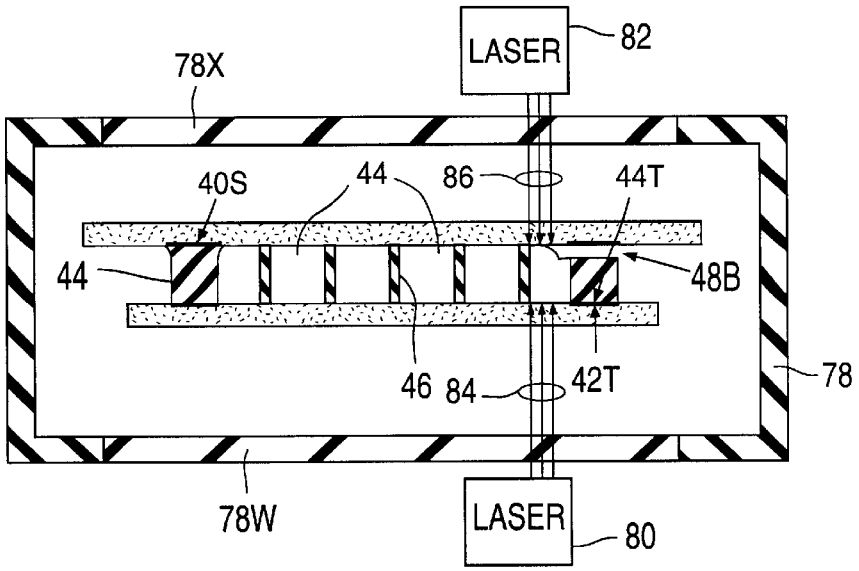

The tacked structure is removed from the alignment system and placed in a vacuum chamber 78, as shown in FIG. 5*d*, for completing the hermetic seal. Vacuum chamber 74 is pumped down to a high vacuum level. The tacked display structure is then raised to a bias temperature of 200° C.–350° C., again typically 300° C., to relieve stress in the material along sealing areas 40S and 42T. The temperature ramp-up is typically performed in the same way as in the process of FIG. 2. Vacuum pumping is continued during the temperature ramp-up to remove gases that outgas from the tacked structure as the temperature rises.

A double-laser system consisting of lasers 80 and 82 is located outside vacuum chamber 78. Lasers 80 and 82 respectively produce laser beams 84 and 86. Lower laser 80 is arranged so that laser beam 84 passes through a quartz window 78W of chamber 78 and then through transparent material of faceplate structure 42 along sealing area 42T. Upper laser 82 is similarly arranged so that laser beam 86 passes through a transparent window 78X of chamber 78 and then through transparent material of baseplate structure 40 along sealing area 40S. Chamber window 78X typically consists of quartz.

With the chamber pressure at vacuum level and with the tacked structure at the above-mentioned bias temperature as in the process of FIG. 2, laser beam 84 and the display are moved relative to each other in such a manner that beam 84 fully traverses the rectangular path along sealing areas 42T and 44T. Laser beam 86 and the display are similarly moved relative to each other so that beam 86 fully traverses the rectangular path along sealing areas 40S and 44S. Laser beams 84 and 86 typically operate simultaneously and in tandem. FIG. 5*d* illustrates an intermediate point during the traversal of laser beams 84 and 86 along the sealing area lengths. If desired, laser beams 84 and 86 can respectively skip the faceplate and backplate tack locations.

As upper laser beam 86 traverses sealing areas 40S and 44S, the light energy of beam 86 is locally transferred to material of outer wall 44 along gap 48A in the same way as in the process of FIG. 2. Consequently, upper material of outer wall 44 jumps gap 48A to fully close it. The light energy of lower beam 48 is likewise locally transferred to material of outer wall 44 along sealing area 42T, causing the entire lower edge of wall 44 to be sealed to faceplate structure 42. The flat-panel display is now hermetically sealed.

Figure 5E:
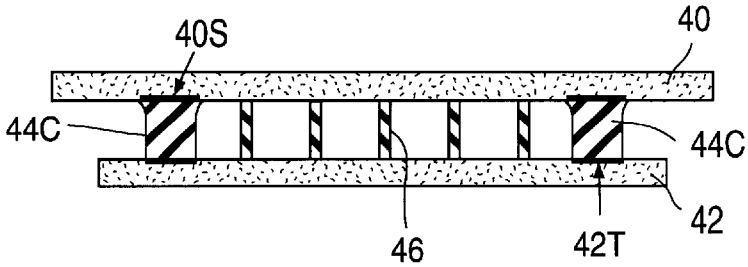

The temperature of the flat-panel display is subsequently cooled down to room temperature. The temperature cool-down is typically performed in the same way as in the process of FIG. 2. After raising the pressure in vacuum chamber 78 to room pressure, the sealed flat-panel display is removed from chamber 78. FIG. 5*e* depicts the final sealed flat-panel display in which item 44C indicates the sealed shape of outer wall 44. Gettering of contaminant gases is performed during the process of FIG. 5 in the same manner as in the process of FIG. 2.

Similar to the neutral-environment/vacuum hybrid alternative described above for the processes of FIGS. 2 and 4, the final gap-jumping laser seal of composite structure 42/44/46 to baseplate structure 40 in FIG. 5*e* can be initiated in a neutral environment (again dry nitrogen or an inert gas such as argon) and completed in a high vacuum. As applied to the process of FIG. 5, the neutral-environment/vacuum hybrid alternative is implemented in the manner described above for the process of FIG. 2 subject to the following changes. Vacuum chamber 78 and laser 82 (which produces laser beam 86) respectively replace vacuum chamber 54 and laser 56 (which produces laser beam 58). While structures 40 and 42/44/46 are in the dry nitrogen or argon environment, laser beam 86 in the process of FIG. 5 performs the same traverse across a large part of the length of aligned sealing areas 40S and 44S that laser beam 58 makes in the process of FIG. 2.

Laser beam 84 of laser 80 in the process of FIG. 5 can travel along a large part, but not all, of the length of aligned sealing areas 42T and 44T while the tacked structure is in dry nitrogen or argon. The travel of beam 84 can, for example, parallel the travel of beam 86 during the neutral-environment step of the gap-jumping laser seal. Alternatively, laser beam 84 traverses the entire length of sealing areas 40T and 42T while the tacked structure is in the dry nitrogen or argon environment. In either case, FIG. 5*e* again illustrates the finally sealed flat-panel display.

When laser tacking is employed in the process of FIG. 5, the variation of FIGS. 2*b and 2*c or the variation of FIGS. 2*c*' and 2*d*' can be applied to the process of FIG. 5. When a tacking structure akin to tack posts 60/62 is utilized in the process of FIG. 5 as a replacement for laser tacking, the variation of FIG. 2*c or 2***d*' can be applied to the so-modified process of FIG. 5. In addition, the material of faceplate structure 42 along sealing 42T in the process of FIG. 5 can be raised to a temperature close to the melting temperature of the material of outer wall 44 along sealing area 44T during the final laser sealing operation and, when employed, the laser tacking operation.

Figure 6:
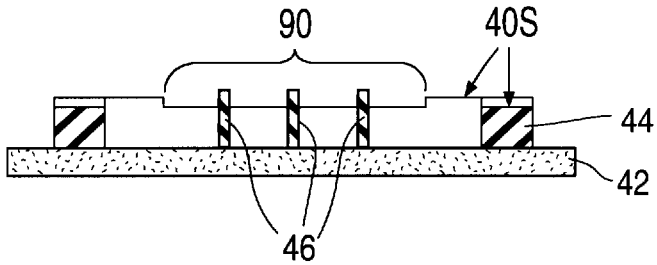
FIG. 6 is a cross-sectional view of a portion of a in flat-panel display having an outer wall provided with venting slots to help in sealing the display by gap jumping in accordance with the invention.
Figure 7:
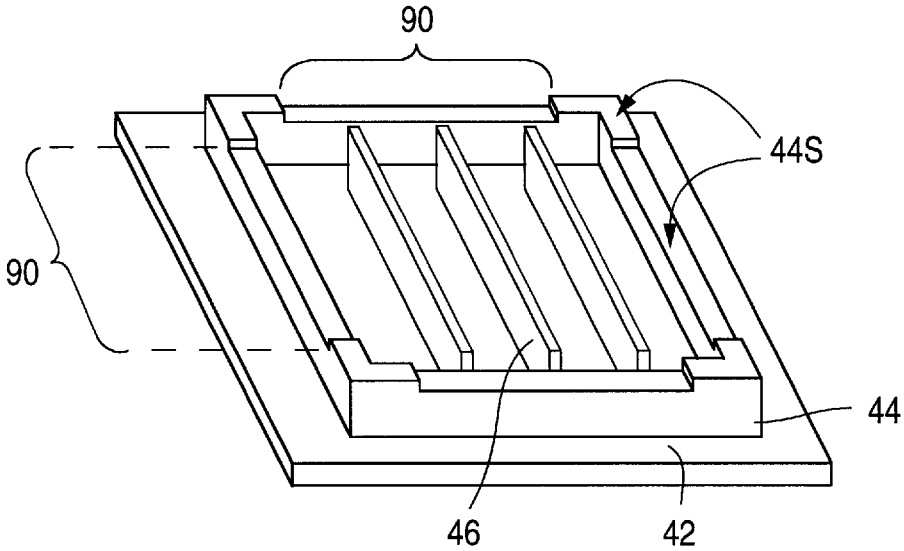
FIG. 7 is a perspective view of the flat-panel display of FIG. 6.

Venting slots can be provided along edge sealing area 44S of outer wall 44 to facilitate removal of contaminant gases during the hermetic sealing operation performed in vacuum chamber 54 or 74 in any of the processes of FIGS. 2, 4, and 5. FIG. 6 illustrates how a cross section of composite structure 42/44/46 appears when venting slots 90 are provided along wall-edge sealing area 44S. FIG. 7 presents a perspective view of structure 42/44/46 with venting slots 90.

In the example of FIGS. 6 and 7, one venting slot 90 is provided in each of the four sub-walls that form outer wall 44. Each venting slot 90 in the illustrated example typically extends for at least 50% of the length of the sub-wall in which that slot 90 is formed. Other arrangements of venting slots 90 can be employed. For example, two or more of slots 90 can be created in one or more of the sub-walls of outer wall 44.

Venting slots 90 can be formed by physically removing portions of outer wall 44 at the slot locations. When the sub-walls of wall 44 are created by firing frit that is in a "green" plastic (soft) state due to the presence of binding material in the frit, slots 90 are preferably formed in the sub-walls by appropriately pressing down on the green frit at the locations for vents 90 until they are formed after which the so-slotted frit is fired. Alternatively, when the sub-walls of wall 44 are in a hard (e.g., fired) state, slots 90 can be created by heating the sub-walls to a temperature sufficient to soften them and then appropriately pressing down on the sub-walls at the location for vents 90.

In both of the pressing techniques, outer wall 44 bulges out laterally just below the locations of slots 90. By creating slots 90 using either of the pressing techniques, the amount of wall material in the immediate vicinity of slots 90 is approximately the same as the amount of wall material elsewhere along wall sealing area 44S. With the volume of wall material utilized in the seal being kept constant along the length of the seal, lateral stress that would otherwise result from the sealing process is reduced. This improves the hermeticity of the gap-jumping laser seal.

Due to the presence of venting slots 90, the height of gap 48 varies from a (non-zero) minimum value to a maximum value rather than being largely uniform as indicated in FIGS. 2*b*, 4*c*, and 5*b*. The difference between the minimum and maximum values of the gap height is the depth of slots 90. The venting slot depth is chosen carefully so as to avoid having the maximum gap height exceed the maximum height, typically at least 300 $\mu$m, that can be jumped by the material of outer wall 44. A venting slot depth of 50 $\mu$m or more, typically 75 $\mu$m, can readily be accommodated when the maximum gap height is in the vicinity of 125 $\mu$m.

Gap jumping to complete the sealing of a flat-panel display can be performed along the interface between the faceplate structure and the outer wall rather than, as described above, along the interface between the baseplate structure and the outer wall. Also, the combination of the outer wall and the particular plate structure that is not sealed to the outer wall by gap jumping can be manufactured by a process other than sealing a largely finished outer wall to that plate structure. FIGS. 8*a*–8*e* (collectively "FIG. 8") illustrate a process that employs these variations for hermetically sealing a flat-panel display utilizing gap jumping according to the invention.

Figure 8A:
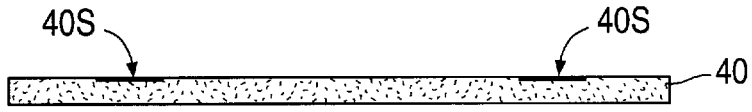
FIGS. 8*a*–8*h* are cross-sectional views representing steps in another process for sealing a flat-panel display using local energy transfer to produce gap jumping in accordance with the invention.
Figure 8B:
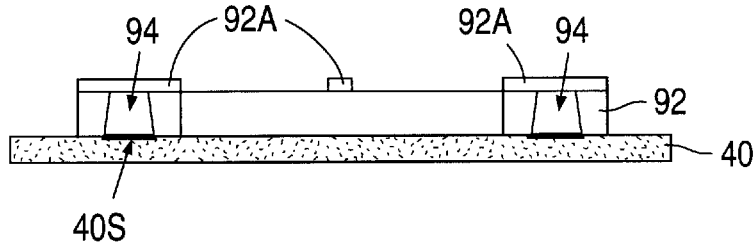

The process of FIG. 8 begins with baseplate structure 40 as shown in FIG. 8*a*. A reverse draft mold 92 having a mold cavity 94 in the desired shape for the outer wall is placed on the interior surface of baseplate structure 40. See FIG. 8*b*. Reverse draft mold 94 overlies the intended location for the outer wall and thus is aligned to sealing area 40S of structure 40. Items 92A in FIG. 8*b* are ridges that connect the inside wall of mold 92 to its outside wall. The inner sides of the walls of mold 92 along cavity 94 slope inward in moving away from baseplate structure 40 in order to facilitate removal of mold 92 after the outer wall is formed. The slope is typically in the vicinity of 10% of the outer wall height.

Figure 8C:
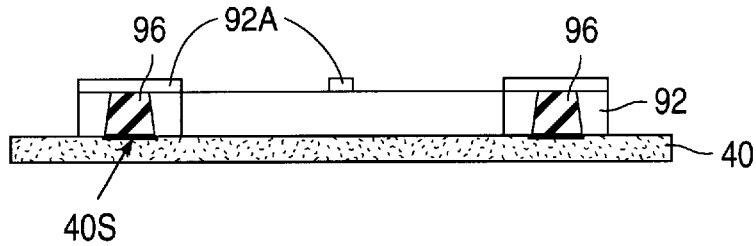
Figure 9:
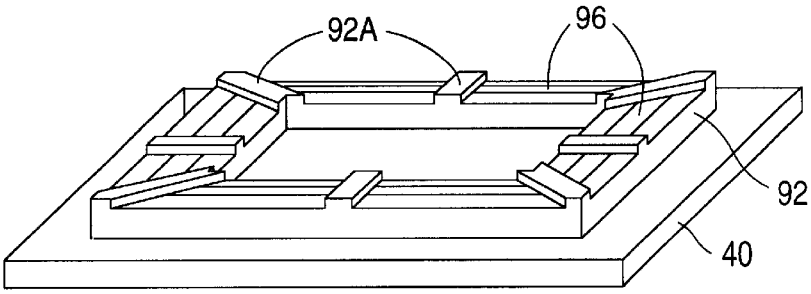
FIG. 9 is a perspective view of the baseplate and filled mold in the flat-panel display of FIG. 8*c*.

Wall material consisting of a slurry of glass, one or more plasticizers, and one or more binders is introduced (injected) into mold cavity 94. The combination of baseplate structure 40 and mold 94 filled with the wall-material slurry is fired at a high temperature to convert the wall material into an outer wall 96 as shown in FIG. 8*c*. FIG. 9 perspectively illustrates the structure at this point. The firing is performed in a oven filled with dry nitrogen moving at a high flow rate.

Figure 8D:
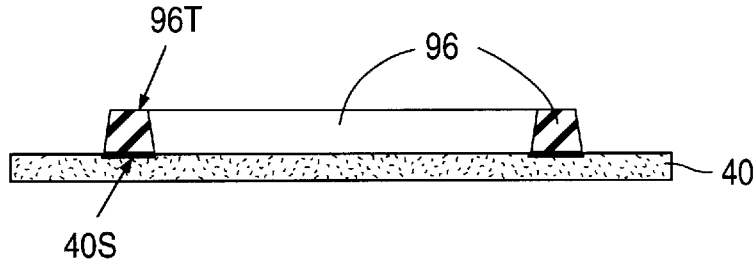

Mold 92 is removed from baseplate structure 40, leaving molded outer wall 96 behind. FIG. 8*d* shows the resultant structure in which outer wall 96 is joined to baseplate structure 40 along sealing area 40S. Item 96T in FIG. 8*d* indicates the remote (upper) edge of wall 96. Composite structure 40/96 is electrically tested.

Outer wall 96 is to be sealed along edge 96T to faceplate structure 42. With spacer walls 46 mounted on the interior surface of faceplate structure 42 within sealing area 42T, composite structures 40/96 and 42/46 are aligned to each other as depicted in FIG. 2*e* utilizing a suitable alignment system (not shown). This entails aligning sealing areas 42T and 96T (vertically in FIG. 8*e*) and bringing the interior surface of faceplate structure 42 into contact with the remote (lower in FIG. 8*e*) edge of spacer walls 46. The alignment is done in a non-vacuum environment normally at room pressure. A getter (not shown) may be provided in the structure of FIG. 8*e* at any of the locations described above for the flat-panel display sealed according to the process of FIG. 2.

Figure 8E:
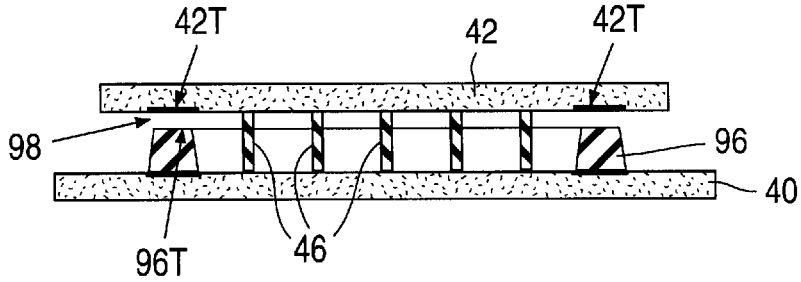

Spacer walls 46 in FIG. 8*e* are sufficiently taller than outer wall 96 that a gap 98 extends between aligned sealing areas 42T and 96T. Similar to gap 48 in the process of FIG. 2, gap 98 extends along at least 50% of the (rectangular) length of sealing areas 42T and 96T, normally along the entire sealing area length. Gap 98 typically has the same height characteristics as gap 48.

Figure 8F:
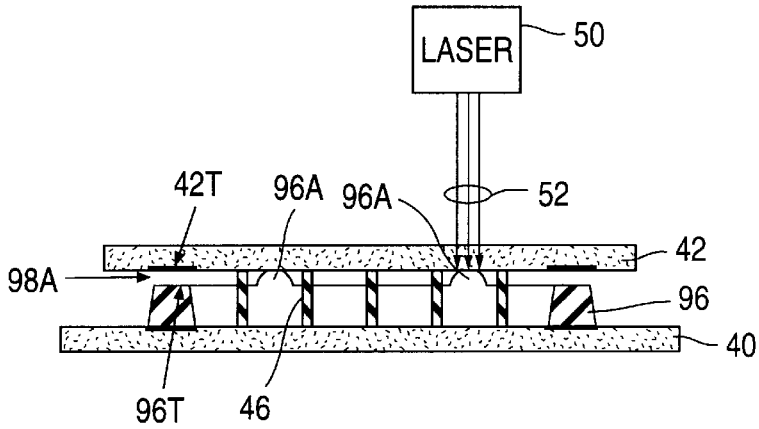

With the alignment system holding composite structures 40/96 and 42/46 in a desired position relative to each other, a tacking operation is performed on the partially sealed flat-panel display to fix this position. The tacking of structures 40/96 and 42/46 can be done in various ways. In the process of FIG. 8, the tacking operation is performed by partial gap jumping in the way described above for the process of FIG. 2 except that portions of gap 98 between faceplate structure 42 and outer wall 96 are jumped rather than portions of gap 48 between baseplate structure 40 and outer wall 44. FIG. 8*f* illustrates the tacking step in which light energy of laser beam 52 of laser 50 causes portions 96A of outer wall 96 to jump gap 98 and become sealed to faceplate structure 42. Item 98A in FIG. 8*f* is the remainder of gap 98.

Figure 8G:
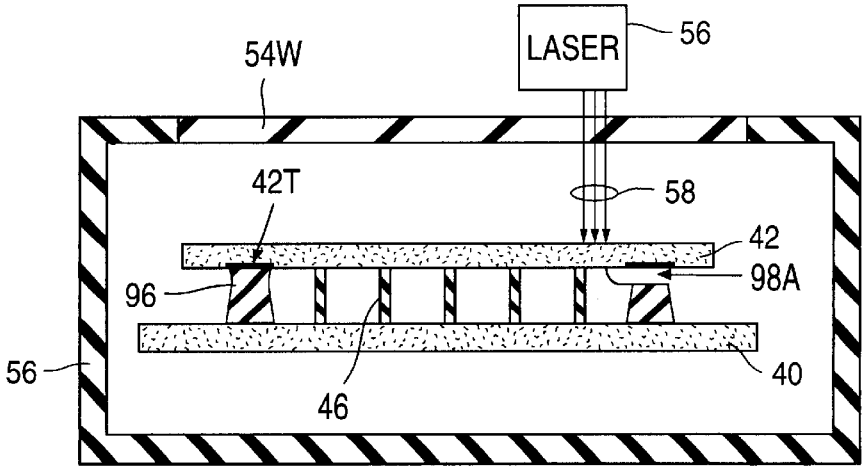
Figure 8H:
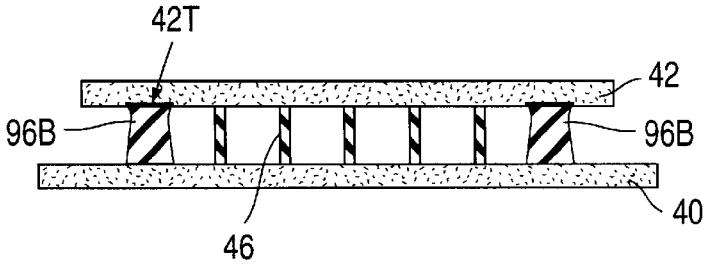

The tacked/partially sealed flat-panel display is removed from the alignment system and placed in vacuum chamber 54 as shown in FIG. 8*g*. Gap jumping is performed to complete the sealing of composite structures 40/96 and 42/46 to each other. Aside from the fact that the gap jumping is performed across gap remainder 98A between faceplate structure 42 and outer wall 96, the gap jumping to bridge remaining gap 98A is performed in the same way as described above for gap remainder 48A in the process of FIG. 2. Due to the local transfer of light energy from laser beam 58 of laser 56, material of outer wall 96 along sealing area edge 96T thus jumps gap remainder 98A and becomes sealed to faceplate structure 42 along sealing area 42T. FIG. 8*h* illustrates the fully sealed structure in which item 96B represents the sealed shape of outer wall 96.

The process of FIG. 8 can be modified generally in the ways described above for the process of FIG. 2. In particular, the final gap-jumping laser seal of composite structure 42/46 to composite structure 40/96 can be initiated in a neutral environment and completed in a high vacuum environment. The variations described above in regard to FIGS. 2*b and 2*c and in regard to FIGS. 2*c*' and 2*d*' in which material of baseplate structure 40 along sealing area 40S is locally heated to a temperature close to the melting temperature of outer wall 44 along sealing area 44S can be applied to the process of FIG. 8. That is, material of faceplate structure 42 along sealing area 42T can be locally heated to a temperature close to the melting temperature of outer wall 96 along edge 96T. This can be done before (FIGS. 2*b and 2*c) or at the same time as (FIGS. 2*c*' and 2*d*') gap jumping is performed across gap 98 during both the laser tacking operation and the final laser sealing operation. Likewise, a positioning structure such as tack posts 60/62 can be employed to tack structure 40/96 to structure 42/46 in the process of FIG. 8. Although the double-laser technique of FIG. 5 is not applicable to the process of FIG. 8, venting slots of the type shown in FIGS. 6 and 7 can be provided along edge 96T of outer wall 96.

The outer wall can be specially shaped to facilitate gap jumping during display sealing, including tacking when the tacking operation is performed by local energy transfer. Forming the outer wall in the shape of a "T" or an inverted "L" is especially beneficial. FIGS. 10*a*–10*e* (collectively "FIG. 10") illustrate a process in which a flat-panel display having an annular outer wall 116 of profile generally in the shape of a "T" is hermetically sealed utilizing gap jumping according to the invention. Except for the special shape of outer wall 116, the steps shown in FIG. 10 substantially replace the steps shown in FIG. 2.

Figure 10A:
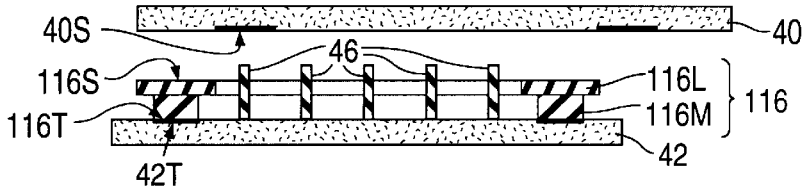
FIGS. 10*a*–10*e* are cross-sectional views representing steps in a further process for sealing a flat-panel display using local energy transfer to produce gap jumping in accordance with the invention.

At the initial stage shown in FIG. 10*a*, baseplate structure 40 is separated from faceplate structure 42 on whose interior surface spacer walls 46 are mounted. Outer wall has an upper edge sealing area 116S and a lower edge sealing area 116T. At the stage of FIG. 10*a*, faceplate structure 42 and outer wall 116 have already been sealed together along sealing areas 42T and 116T, typically according to the procedure utilized in the process of FIG. 2 for sealing faceplate structure 42 to outer wall 44. In composite structure 42/46/116, spacer walls 46 are taller than outer wall 116 and thus extend further away from the interior surface of faceplate structure 42 than outer wall 116.

Outer wall 116 consists of an upper portion 116L and a lower portion 116M. Upper wall portion 116L is wider than lower wall portion 116M. Typically, the width (in the horizontal direction in FIG. 10) of upper wall portion 116L is approximately 10% to 50% wider than lower wall portion 116M. The upper side of upper portion 116L constitutes wall-edge sealing area 116S, while the lower edge of lower portion 116M constitutes wall-edge sealing area 116T. The upper edge of portion 116M meets the lower side of portion 116L approximately midway along the (lateral) width of portion 116L so that outer wall 116 is generally T-shaped as viewed in cross section.

Outer wall 116, configured in a rectangular annulus of four sub-walls, can be formed in various ways. In each sub-wall, portions 116L and 116M can be formed separately and later joined together. Alternately, wall portions 116L and 116M in each sub-wall can be a unitary piece of material formed, for example, by a molding, extruding, laminating, or pressing process. Wall portions 116L and 116M in each sub-wall typically consist of frit.

Figure 10B:
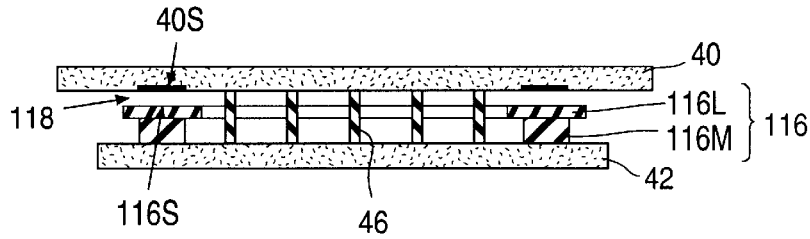

Using a suitable alignment system (not shown), structures 40 and 42/46/116 are aligned to each other in the manner depicted in FIG. 10*b* so that sealing area 40S of baseplate structure 40 vertically overlies wall-edge sealing area 116S. The alignment is performed in the way described above for the process of FIG. 2. Since spacer walls 46 are taller than outer wall 116, a gap 118 extends between aligned sealing areas 40S and 116S along the entire perimeter of structures 40 and 42/46/116. Gap 118 has the same characteristics as gap 48 in the process of 42, except that gap 118 can be larger than gap 48.

Figure 10C:
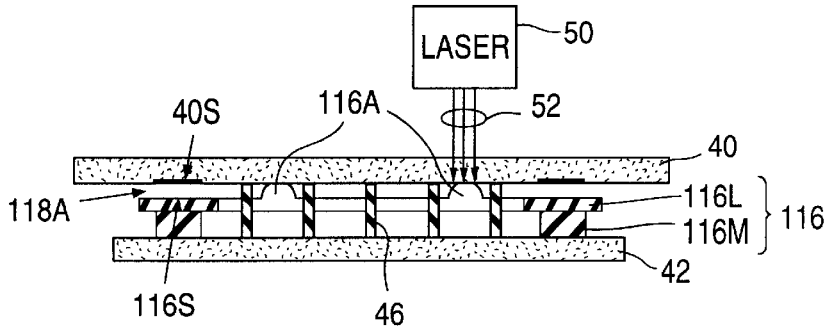

A tacking operation is performed with laser 50 in the manner described above for the process of FIG. 2 to join baseplate structure 40 to composite structure 42/46/116 at several separate locations along sealing areas 40S and 116S. See FIG. 10*c* in which portions 116A of upper wall portion 116L jump gap 118 at the tack locations and become strongly sealed to baseplate structure 40. Although not shown in FIG. 10*c*, the light energy locally transferred by laser beam 52 to upper wall portion 116L at the tack locations along sealing area 116S leads to lateral compression of wall portion 116L at the tack locations. This phenomenon, discussed further below in connection with the final laser sealing, facilitates the gap jumping that produces upward-protruding tack portions 116A. Item 118A in FIG. 10*c* is the remainder of gap 118.

Figure 10D:
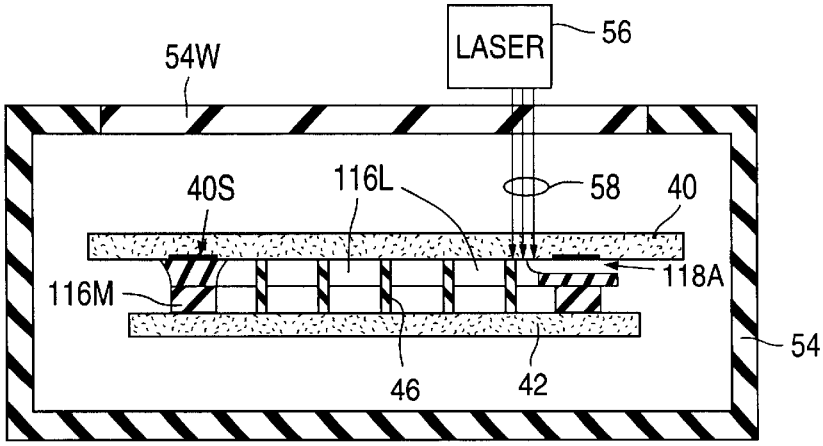
Figure 10E:
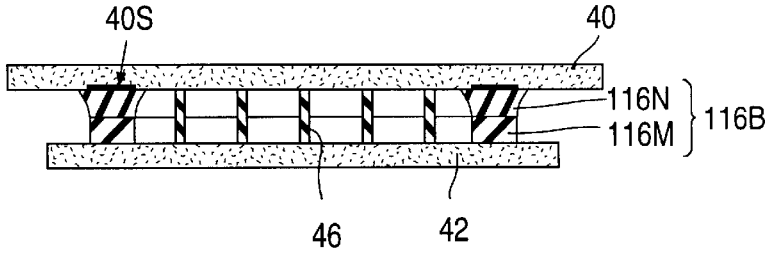

Final sealing is performed with laser 56 in vacuum chamber 54 in the manner described above for the process of FIG. 2 in order to close gap remainder 118A and hermetically seal baseplate structure 40 to composite structure 42/46/116. FIG. 10*d* illustrates an intermediate point in the final sealing operation. Light energy transferred locally by laser beam 58 to upper wall portion 116 along sealing area 116S leads to a lateral compression in wall portion 116L, as shown in the left half of FIG. 10*d*, to facilitate the gap jumping.

More particularly, upper wall portion 116L is chosen to be of such height that substantially the entire cross section of portion 116L melts as laser beam 58 traverses upper wall edge 116S. When the wall material melts, surface tension causes upper wall portion 116L to compress laterally along its width, thereby forcing material of wall portion 116L upward. Consequently, making upper wall portion 116L wider than lower wall portion 116M enables gap 118 to be bridged easier. Also, the height of gap 118 can be increased compared to the height of gap 48 for flat-panel devices that are identical except for the outer wall shape.

From this point on, the flat-panel display of FIG. 10 is processed in the manner described above for the process of FIG. 2. FIG. 10*e* depicts the resulting sealed flat-panel display. Item 116B indicates the sealed shape of outer wall 116, while item 116M indicates the sealed shape of upper wall portion 116L. All of the above-described variations to the sealing process of FIG. 2 can be applied to the sealing process of FIG. 10. Largely all of the benefits that occur with T-shaped outer wall 116 arise when the outer wall is in the shape of an inverted L.

The geometries of the laser beams (e.g., laser beams 52 and 58) that deliver light energy locally to material along edge sealing area 44S or 44T of outer wall 44, edge sealing area 96T of outer wall 96, or edge sealing area 116S of outer wall 116 can be tailored to provide a desired energy distribution and, consequently, a desired temperature distribution across the width of sealing area 44S, 44T, 96T, or 116S. Preferably, the energy distribution across the width of sealing area 44S, 44T, 96T, or 116S is largely uniform so that the temperature is largely constant across the width of area 44S, 44T, 96T, or 116S at each width location along the length of area 44S, 44T, 96T, or 116S. By scanning the laser beam at a relatively constant rate along the length of area 44S, 44T, 96T, or 116S, each point of area 44S, 44T, 96T, or 116S is raised to largely the same temperature during the sealing process, except possibly for points where area 44S, 44T, 96T, or 116S curves. This reduces the likelihood of causing sealing defects due to non-uniform temperature.

In particular, the laser beam that provides light energy locally to material along wall-edge sealing area 44S, 44T, 96T, or 116S preferably is of rectangular, normally square, cross section scanned at a largely constant rate along the sealing area length. Provided that the rectangular beam covers the entire sealing area width, the distribution of energy locally furnished by the rectangular beam is largely uniform over the width and length of the sealing area, except possible at the sealing area corners. Each point along sealing area 44S, 44T, 96T, or 116T except possibly the corners then reaches largely the same temperature along the sealing area width and length.

With the rectangular beam providing a largely uniform temperature distribution, few bubbles are formed in the frit typically utilized for outer wall 44, 96, or 116. This is a substantial improvement over a conventional circular laser beam in which the concentration of light energy near the middle of the path traversed by the circular beam appears to be one of the main reasons for bubble formation in frit traversed by the circular beam. Eliminating the bubbles in the frit avoids loss of strength due to the bubbles. Accordingly, use of a specially tailored laser beam, preferably a beam of rectangular cross-section, in accordance with the invention for delivering light energy locally to material along sealing area 44S, 44T, 96T, or 116S results in a stronger seal compared to a circular laser beam.

FIG. 11*a* generally illustrates the main features of a laser system that delivers a laser beam 100 of generally rectangular cross section 102 as shown in FIG. 11*b*. The laser system in FIG. 11*a* consists of a beam-producing section 104 and a fiber optics cable formed with optical fibers 106 and cylindrical casing 108 that encloses optical fibers 106. Casing 108 is shaped as a rectangular annulus that provides substantially total reflection of the photons transmitted down optical fibers 106. Consequently, beam cross section 102 is approximately rectangular, again normally square.

FIG. 11*c* depicts how rectangular laser beam 100 traverses the upper edge 110S of a frit wall 110. The leading edge 102L of rectangular cross section 102 extends perpendicular to the length of sealing area 110S and extends fully across the width of sealing 110S. Since the trailing edge 102T of beam cross section 102 runs parallel to leading edge 102L, the energy distribution across the width of sealing area 110S is largely constant along any line running perpendicular to the length of sealing area 110S. By scanning laser beam 100 at a constant rate along the length of sealing area 110S, the distribution of beam energy is substantially uniform across all of area 110S, except possibly at corners where sealing area 110S curves. If leading edge 102L is not perpendicular to the length of sealing area 110S, a largely uniform energy distribution is still obtained (except possibly at curved regions of sealing area 110S), providing that both leading edge 102L and trailing edge 102T extend fully across sealing area 110S.

While the invention has been described with reference to particular embodiments, this is solely for the purpose of illustration and is not to be construed as limiting the scope of the invention claimed below. For example, material of baseplate structure 40 along sealing area 40S in the process of FIGS. 2, 4, or 5 could move part of the way towards outer wall 44 so as to help bridge gap 48 or gap remainder 48A. Likewise, baseplate structure material along sealing area 40S in the process of FIG. 10 could move part of the way towards outer wall 116 so as to help jump gap 118 or gap remainder 118A. Such movement of baseplate structure material along sealing area 40S could be caused by surface tension as the material softens slightly after being raised to elevated temperature even though the temperature is not high enough to cause the material to melt.

Alternatively, energy may be transferred locally to baseplate structure 40 along sealing area 40S to cause that material to melt and move partway toward wall 44 or 116 without causing other parts of baseplate structure 40 to melt or otherwise degrade. This local energy transfer could be performed with focused light energy provided by a laser or with another type of focused or locally directed energy. In the same way, material of faceplate structure 42 along sealing area 42T in the process of FIG. 8 could move partway toward outer wall 96 so as to help bridge gap 98 or gap remainder 98A. Although gap jumping is typically performed only at the interface between outer wall 44, 96, or 116 and one of plate structures 40 and 42, gap jumping can be performed at both the baseplate structure/outer wall interface and the faceplate structure/outer wall interface.

The local energy transfer that causes gap jumping in the invention can be implemented with locally directed energy other than light energy supplied from a laser or a focused lamp. One example of interest is focused RF wave energy provided from a suitably focused RF wave source. Taking note of the fact that microwaves fall near the middle of the RF wave band, the local energy can specifically be focused microwave energy furnished from a suitably focused microwave source. Instead of using focusing to produce a beam of energy for use in the invention, a masking technique can be employed to block energy transmission that goes in undesired directions and thereby produce an energy beam that goes in a desired direction.

Combinations of different types of local light energy sources can be employed to perform multiple local energy transfers in sealing a flat-panel display using gap jumping according to the invention. For instance, tacking of a flat-panel display can be done with a laser, a focussed lamp, or a locally directed RF energy source, including a microwave source, while final sealing is done with another of these local energy sources. When the final sealing operation is initiated in a non-vacuum environment and completed in a high vacuum, one of the preceding local energy sources can be used for the non-vacuum portion of the final sealing operation while another is used for the high-vacuum portion.

Outer wall 44 can have a shape other than a rectangular annulus. Materials in addition to frit can be used in outer wall 44. For instance, outer wall 44 can consist of glass or/and ceramic along the central portion of wall 44. Frit can then be provided at the top and bottom of wall 44 for achieving hermetic sealing according to the invention.

The invention can be employed to hermetically seal flat-panel devices other than displays. Examples include (a) microchannel plates in high-vacuum cells similar to photo multipliers, (b) micromechanical packages for devices such as accelerometers, gyroscopes, and pressure sensors, and (c) packages for biomedical implants. Various modifications and applications may thus be made by those skilled in the art without departing from the true scope and spirit of the invention as defined in the appended claims.

We claim:

1. A method comprising the steps of:

attaching a first plate structure to a second plate structure through attaching means positioned at least partially between the plate structures while the plate structures are in a non-vacuum environment, the attaching means being spaced laterally apart from an outer wall mounted over a specified one of the plate structures and having a sealing edge that defines a sealing location with the other of the plate structures such that the outer wall lies between the plate structures; and subsequently hermetically sealing the plate structures together through the outer wall generally along the sealing location while the plate structures are in a vacuum environment such that a vacuum is largely present in a resultant sealed enclosure between the plate structures and intervening outer wall.

2. A method as in claim 1 wherein the attaching step is performed at a pressure close to room pressure.

3. A method as in claim 1 wherein the sealing step is performed at a pressure no greater than $10^{-2}$ torr.

4. A method as in claim 1 wherein the attaching of the plate structures to each other during the attaching step causes the plate structures to be in a substantially fixed position relative to each other during the sealing step.

5. A method as in claim 1 further including, prior to the attaching step, the step of aligning the plate structures to each other.

6. A method as in claim 1 wherein the plate structures are hermetically sealed to each other through sealing material placed between the plate structures and over the sealing edge of the outer wall.

7. A method as in claim 6 wherein the specified plate structure is the first plate structure, the method further including, prior to the attaching step, the steps of:

mounting the outer wall over the first plate structure along a further edge of the outer wall opposite its sealing edge; and providing the sealing material over the sealing edge of the outer wall such that the sealing material overlies the first plate structure.

8. A method as in claim 7 wherein:

the attaching step is performed such that, subsequent to the attaching step and prior to the sealing step, a gap at least partially separates the second plate structure from the sealing material; and the sealing step comprises transferring energy to the sealing material to cause it to bridge the gap.

9. A method as in claim 8 wherein the energy-transferring step comprises transferring energy locally to the sealing material.

10. A method as in claim 7 further including, prior to the attaching step, the step of providing the attaching means over the first plate structure such that, prior to the scaling step, the attaching means extends further away from the first plate structure than does the scaling material.

11. A method as in claim 1 wherein the attaching means comprises:

intermediate means joined to one of the plate structures; and adhesive which bonds the intermediate means to the other of the plate structures.

12. A method as in claim 1 wherein the plate structures constitute a baseplate structure and a faceplate structure of a flat-panel display.

13. A method as in claim 12 wherein the flat-panel display is of the cathode-ray tube type.

14. A method as in claim 13 wherein:

one of the plate structures comprises means for emitting electrons; and the other of the plate structures comprises means for emitting light upon being struck by electrons emitted by the electron-emitting means.

15. A method comprising the steps of:

attaching a first plate structure to a second plate structure at multiple attachment locations spaced laterally apart along the plate structures while the plate structures are in a non-vacuum environment, the attachment locations being spaced laterally apart from an outer wall mounted over a specified one of the plate structures and having an outer edge that defines a sealing location with the other of the plate structures; and subsequently hermetically sealing the plate structures together through the outer wall generally along the sealing location while the plate structures are in a vacuum environment such that a vacuum is largely present in a resultant sealed enclosure between the plate structures and intervening outer wall.

16. A method as in claim 15 wherein the attaching step is performed at a pressure close to room pressure.

17. A method as in claim 15 wherein the scaling step is performed at a pressure no greater than $10^{-2}$ torr.

18. A method as in claim 15 wherein the attaching of the plate structures to each other during the attaching step causes the plate structures to be in a substantially fixed position relative to each other during the sealing step.

19. A method as in claim 15 further including, prior to the attaching step, the step of aligning the plate structures to each other.

20. A method as in claim 1 wherein the plate structures are hermetically sealed to each other through sealing material placed between the plate structures and over the sealing edge of the outer wall.

21. A method as in claim 20 wherein the specified plate structure is the first plate structure, the method further including, prior to the attaching step, the steps of:

mounting the outer wall over the first plate structure along a further edge of the outer wall opposite its sealing edge; and providing the sealing material over the sealing edge of the outer wall such that the sealing material overlies the first plate structure.

22. A method as in claim 21 wherein:

the attaching step comprises tacking the plate structures together through multiple tacking elements spaced laterally apart from one another and from the outer wall; and the sealing step comprises joining the sealing material to the second plate structure.

23. A method as in claim 22 wherein each tacking element comprises:

a tack post joined to one of the plate structures; and adhesive which bonds the tack post to the other of the plate structures.

24. A method as in claim 21 wherein:

the attaching step is performed such that, subsequent to the attaching step and prior to the sealing step, a gap at least partially separates the second plate structure from the sealing material; and the sealing step comprises transferring energy to the sealing material to cause it to bridge the gap.

25. A method as in claim 24 wherein the energy-transferring step comprises transferring energy locally to the sealing material.

26. A method as in claim 15 wherein the plate structures constitute a baseplate structure and a faceplate structure of a flat-panel display.

27. A method as in claim 26 wherein the flat-panel display is of the cathode-ray tube type.

28. A method as in claim 27 wherein:

one of the plate structures comprises means for emitting electrons; and the other of the plate structures comprises means for emitting light upon being struck by electrons emitted by the electron-emitting means.

29. A method comprising the steps of:

attaching a first plate structure to a second plate structure through attaching means positioned at least partially between the plate structures while the plate structures are in a non-vacuum environment such that a gap at least partially separates the second plate structure from sealing material provided over the first plate structure; and subsequently hermetically sealing die plate structures together by transferring energy to the sealing material to cause it to bridge die gap while the plate structures are in a vacuum environment such that a vacuum is largely present in a resultant sealed enclosure between the plate structures.

30. A method as in claim 29 wherein the attaching step is performed at a pressure close to room pressure.

31. A method as in claim 29 wherein the sealing step is performed at a pressure no greater than $10^{-2}$ torr.

32. A method as in claim 29 wherein the sealing step comprises transferring energy locally to the sealing material.

33. A method as in claim 29 wherein the plate structures constitute a baseplate structure and a faceplate structure of a flat-panel display of the cathode-ray tube type.

34. A method as in claim 29 wherein:

one of the plate structures comprises means for emitting electrons; and the other of the plate structures comprises means for emitting light upon being struck by electrons emitted by the electron-emitting means.

35. A method comprising the steps of:

attaching a first plate structure to a second plate structure at multiple locations spaced laterally apart along the plate structures while the plate structures are in a non-vacuum environment such that a gap at least partially separates the second plate structure from sealing material provided over the first plate structure; and subsequently hermetically sealing the plate structures together by transferring energy to the sealing material to cause it to bridge the gap while the plate structures are in a vacuum environment such that a vacuum is largely present in a resultant sealed enclosure between the plate structures.

36. A method as in claim 35 wherein the sealing step comprises transferring energy locally to the sealing material.

* * * * *